US008559856B2

(12) United States Patent
Suzuki et al.

(10) Patent No.: US 8,559,856 B2
(45) Date of Patent: Oct. 15, 2013

(54) DEVELOPMENT DEVICE AND IMAGE FORMING APPARATUS INCORPORATING SAME

(75) Inventors: Yuji Suzuki, Tokyo (JP); Akihiro Takayama, Kanagawa (JP); Kentarou Nodera, Kanagawa (JP); Hiroyuki Uenishi, Kanagawa (JP); Susumu Tateyama, Kanagawa (JP); Shinnosuke Koshizuka, Kanagawa (JP); Tatsuya Kubo, Tokyo (JP); Kohichi Yamazaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 253 days.

(21) Appl. No.: 13/137,194

(22) Filed: Jul. 27, 2011

(65) Prior Publication Data

US 2012/0051797 A1 Mar. 1, 2012

(30) Foreign Application Priority Data

Aug. 27, 2010 (JP) ..... 2010-190373
Oct. 19, 2010 (JP) ..... 2010-234104
May 31, 2011 (JP) ..... 2011-121747

(51) Int. Cl.
*G03G 15/09* (2006.01)

(52) U.S. Cl.
USPC ..... 399/272; 399/274; 399/277

(58) Field of Classification Search
USPC ..... 399/272, 274, 277
See application file for complete search history.

(56) References Cited

U.S. PATENT DOCUMENTS 4,193,376 A * 3/1980 Hamaguchi et al. ..... 399/272
4,804,995 A * 2/1989 Osawa et al. ..... 399/273
5,768,666 A * 6/1998 Ito et al. ..... 399/273
6,229,978 B1 * 5/2001 Naito et al. ..... 399/272
6,308,035 B1 * 10/2001 Fukuda ..... 399/254
7,792,465 B2 9/2010 Kubo et al.
7,792,466 B2 9/2010 Nakayama et al.
7,813,680 B2 10/2010 Masuda et al.

(Continued)

FOREIGN PATENT DOCUMENTS

JP 60-073662 4/1985
JP 61-170766 8/1986

(Continued)

OTHER PUBLICATIONS

Search Report dated Dec. 2, 2011 issued in corresponding European Application No. 11176410.6.

*Primary Examiner* — David Gray
*Assistant Examiner* — Francis Gray
(74) *Attorney, Agent, or Firm* — Harness, Dickey & Pierce, P.L.C.

(57) ABSTRACT

A development device includes a developer bearer to carry the developer to a development range, a magnetic field generator disposed inside the developer bearer for generating magnetic force, a developer regulator for adjusting an amount of the developer, a developer supply compartment disposed adjacent to the developer bearer, separated by a side wall from a portion where the developer bearer is provided, a developer agitator provided in the supply compartment, and a blocker disposed above the side wall of the supply compartment across a supply gap through which the developer moves from the supply compartment. The magnetic field generator has an attraction magnetic pole and a regulation magnetic pole. The blocker prevents the developer blocked by the developer regulator from moving along a magnetic force line of the regulation magnetic force toward the circumferential surface of the developer bearer.

20 Claims, 11 Drawing Sheets

(56) References Cited

U.S. PATENT DOCUMENTS

| | | | | |
|---|---|---|---|---|
| 7,826,775 | B2 | 11/2010 | Nakayama et al. | |
| 7,904,001 | B2 | 3/2011 | Tateyama et al. | |
| 8,041,269 | B2 * | 10/2011 | Kubo et al. | 399/269 |
| 2003/0044197 | A1 * | 3/2003 | Ohyama | 399/104 |
| 2003/0044713 | A1 * | 3/2003 | Yamaguchi et al. | 430/122 |
| 2007/0212130 | A1 | 9/2007 | Kuwabara et al. | |
| 2007/0274742 | A1 | 11/2007 | Nakayama et al. | |
| 2007/0280744 | A1 | 12/2007 | Kubo et al. | |
| 2008/0199205 | A1 | 8/2008 | Kubo et al. | |
| 2008/0199223 | A1 | 8/2008 | Tateyama et al. | |
| 2008/0213006 | A1 | 9/2008 | Nakayama et al. | |
| 2008/0240792 | A1 | 10/2008 | Kita et al. | |
| 2008/0240793 | A1 * | 10/2008 | Kobayashi et al. | 399/267 |
| 2008/0247786 | A1 | 10/2008 | Nakayama et al. | |
| 2008/0253810 | A1 | 10/2008 | Tateyama et al. | |
| 2009/0067878 | A1 | 3/2009 | Tateyama et al. | |
| 2009/0067886 | A1 | 3/2009 | Nodera et al. | |
| 2009/0080913 | A1 | 3/2009 | Suzuki | |
| 2009/0097878 | A1 | 4/2009 | Kubo et al. | |
| 2009/0103954 | A1 | 4/2009 | Nakayama et al. | |
| 2009/0136257 | A1 | 5/2009 | Hattori et al. | |
| 2009/0190960 | A1 | 7/2009 | Hirayama et al. | |
| 2009/0245882 | A1 | 10/2009 | Ozeki et al. | |
| 2009/0245887 | A1 | 10/2009 | Masuda et al. | |
| 2009/0245889 | A1 | 10/2009 | Koetsuka et al. | |
| 2009/0290913 | A1 * | 11/2009 | Itagaki et al. | 399/277 |
| 2011/0008073 | A1 * | 1/2011 | Kudo et al. | 399/254 |
| 2011/0058857 | A1 | 3/2011 | Hori et al. | |

FOREIGN PATENT DOCUMENTS

| | | | | |
|---|---|---|---|---|
| JP | 61170766 | A | * | 8/1986 |
| JP | 62-108273 | | | 5/1987 |
| JP | 11007186 | A | | 1/1999 |
| JP | 2002196574 | A | | 7/2002 |
| JP | 2007279330 | A | | 10/2007 |
| JP | 2008256813 | A | | 10/2008 |

* cited by examiner

DEVELOPMENT DEVICE AND IMAGE FORMING APPARATUS INCORPORATING SAME

CROSS-REFERENCE TO RELATED APPLICATIONS

This patent application is based on and claims priority pursuant to 35 U.S.C. §119 to Japanese Patent Application Nos. 2010-190373 filed on Aug. 27, 2010, 2010-234104 filed on Oct. 19, 2010, and 2011-121747 filed on May 31, 2011, in the Japan Patent Office, the entire disclosure of which is hereby incorporated herein by reference.

FIELD OF THE INVENTION

The present invention generally relates to a development device that uses two-component developer consisting essentially of toner and carrier, and an image forming apparatus, such as a copier, a facsimile machine, a printer, or multifunction machine capable of at least two of these functions, that includes the development device.

BACKGROUND OF THE INVENTION

In image forming apparatuses such as electrophotographic copiers, electrostatic recording devises, or magnetic recording devices, two-component type development devices using two-component developer are widely used for developing electrostatic latent images formed on latent image bearers.

Such two-component development devices typically include a developer bearer rotatable relative to a casing of the development device, a stationary magnetic field generator provided inside the developer bearer, and a developer regulator disposed across a gap (regulation gap) from the surface of the developer bearer, upstream in the direction of rotation of the developer bearer from a development range facing a latent image bearer. The magnetic field generator has multiple magnetic poles and may be constructed of multiple magnets. The magnetic field generator includes an attraction pole or pump-up pole for generating a magnetic force to attract the developer (i.e., developer particles) to the surface of the developer bearer (hereinafter "attraction magnetic force") and a development pole for generating a magnetic force to cause the developer to stand on end on the developer bearer in the development range.

With the magnetic force generated by the magnetic field generator, the developer is carried on the surface of the developer bearer and transported to the development range. In the development range, the developer standing on end on the developer bearer forms a magnetic brush, which slidingly contacts the surface of the latent image bearer. Then, toner in the developer adheres to the electrostatic latent image formed on the latent image bearer, thus developing it into a toner image (development process).

For example, JP-2008-256813-A proposes a two-component development device in which a developer supply compartment and a developer collection compartment are formed by the casing and interior wall therein, and conveyance screws (i.e., developer supply screw and developer collecting screw) are provided therein. The developer supply compartment is positioned adjacent to the developer bearer, and a side wall of the developer supply compartment or a partition divides, at least partially, the developer supply compartment from the portion where the developer bearer is provided. The developer supply screw supplies the developer from the developer supply compartment to the developer bearer while transporting the developer in the axial direction of the developer bearer. The developer in the developer supply compartment overstrides the side wall and is carried on the surface of the developer bearer due to the attraction magnetic force.

As the developer bearer rotates, the developer reaches the regulation gap, which is a gap between the surface of the developer bearer and the developer regulator. Only the developer adjacent to the surface of the developer bearer can pass through the regulation gap, and the developer positioned away from the surface of the developer bearer is blocked by the developer regulator. Thus, with the regulation gap, the amount of developer transported to the development range can be adjusted, and the developer removed by the developer regulator from the developer bearer is returned to the supply compartment and is again supplied to the developer bearer. Thus, the developer is circulated inside the development device.

The amount of developer transported to the regulation gap, however, fluctuates when the properties of the developer, such as fluidity, change due to the degradation of the developer over time or changes in the environment. In this case, the development ability becomes unstable.

In view of the foregoing, several approaches have been tried. For example, the magnetic field generator may be configured to have another magnetic pole for generating a magnetic force to cause the developer to stand on end on the developer bearer (hereinafter "regulation magnetic force") when the developer passes through the regulation gap to alleviate the fluctuation in the amount of developer supplied to the development range.

Although this approach is effective to a certain extent, the regulation magnetic force can also act on the developer blocked by the developer regulator, retaining such developer (hereinafter "retained developer") in a portion downstream from the developer regulator in the direction of rotation of the developer bearer (hereinafter "retaining portion"). In the retaining portion, the retained developer is circulated in the direction opposite the direction of rotation of the developer bearer. While thus retained by the regulation magnetic force and circulating in the retaining portion, the retained developer is further electrically changed by sliding contact. Accordingly, the amount of charge of the toner in the retained developer is higher than that of the other developer circulated in the development device, and thus the development ability, that is, the amount per unit area of toner adhering to the electrostatic latent image during the development process, is different therebetween.

Although unevenness in image density can be limited as long as such developers having different levels of development ability are mixed well, the unevenness in image density is visible if they are mixed insufficiently, degrading the image quality. In conventional development devices, it may be difficult to sufficiently mix developers having different levels of development ability. Consequently, unevenness in image density can occur, and accordingly the image quality can be degraded.

SUMMARY OF THE INVENTION

In view of the foregoing, in one illustrative embodiment of the present invention, a development device includes a cylindrical developer bearer to carry by rotation two-component developer to a development range where the developer bearer faces a latent image bearer, a magnetic field generator disposed inside the developer bearer for generating magnetic force to keep the developer on a circumferential surface of the developer bearer, a developer regulator disposed upstream from the development range and facing the circumferential surface of the developer bearer across a regulation gap for adjusting an amount of the developer carried by the developer bearer to the development range, a supply compartment disposed adjacent to the developer bearer, from which the developer is supplied to the developer bearer and in which the developer removed from the developer bearer by the developer regulator is collected, and a developer agitator provided in the supply compartment for transporting the developer in an axial direction of the developer bearer. A side wall partially separates the supply compartment from a portion where the developer bearer is provided, and a blocker is provided facing an upper end of the side wall of the supply compartment across a supply gap through which the developer moves from the supply compartment toward the developer bearer. The supply gap extends at least over the entire development range in the axial direction of the developer bearer. The blocker prevents the developer blocked by the developer regulator from moving along a magnetic force line of the regulation magnetic force toward the circumferential surface of the developer bearer. The magnetic field generator includes an attraction magnetic pole for generating an attraction magnetic force to attract the developer from the supply compartment over the upper end of the side wall of the supply compartment to the circumferential surface of the developer bearer as well as a regulation magnetic pole for generating a regulation magnetic force to cause the developer passing through the regulation gap to stand on end on the circumferential surface of the developer bearer.

In another illustrative embodiment, the attraction magnetic pole and the regulation magnetic pole of the magnetic field generator are adjacent to each other and have the opposite polarities.

In another illustrative embodiment, an image forming apparatus includes a latent image bearer on which an electrostatic latent image is formed and the above-described development device.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
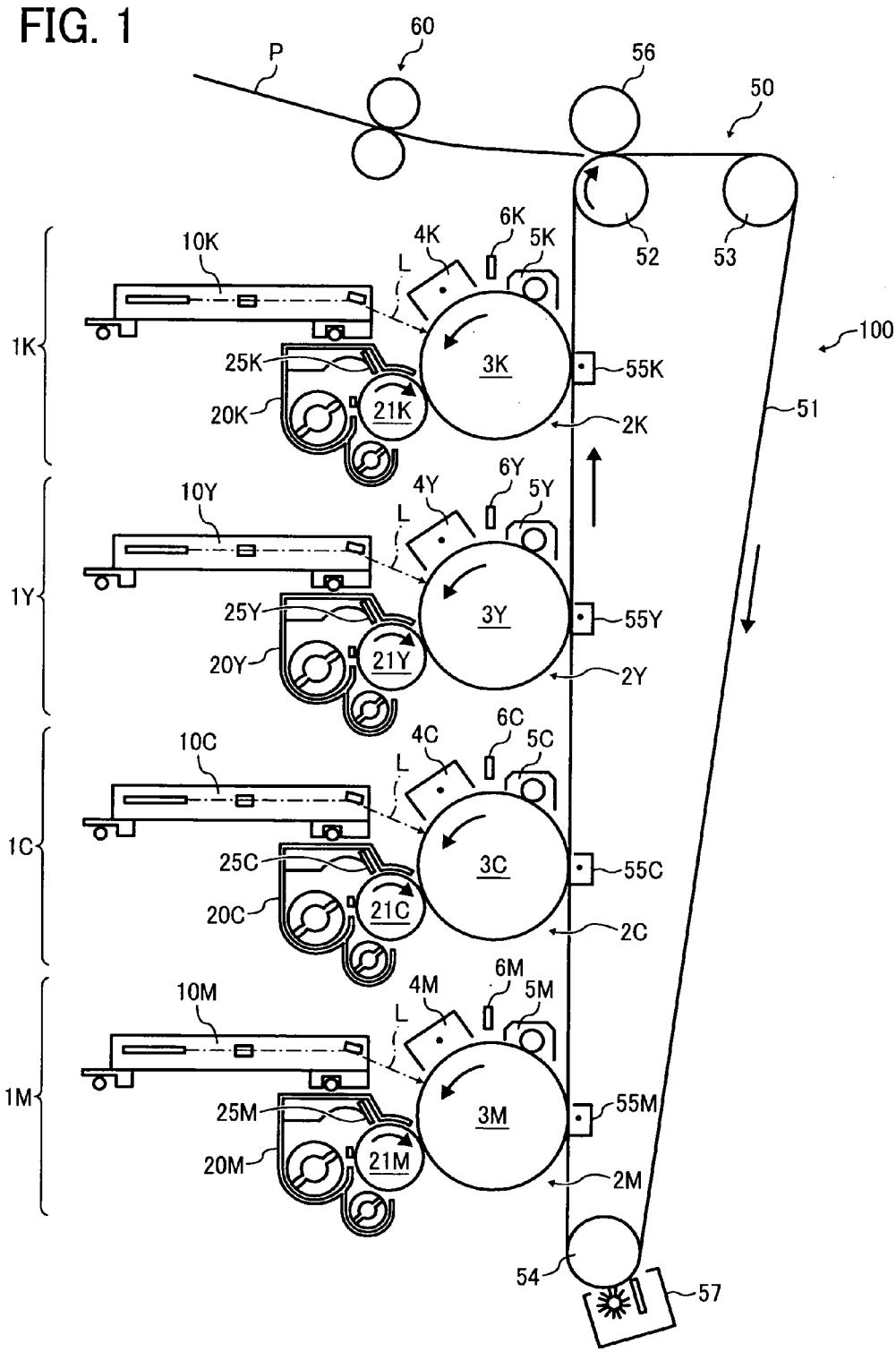
FIG. 1 is a schematic diagram of an image forming apparatus according to an embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a multicolor image forming apparatus according to an illustrative embodiment of the present invention is described.

First Embodiment

An image forming apparatus according to one embodiment of the present invention, which may be a multicolor laser printer, is described below.

FIG. 1 is a schematic diagram of an image forming apparatus 100 according to the present embodiment.

The image forming apparatus 100 includes four image forming stations 1M, 1C, 1Y, and 1K for forming magenta, cyan, yellow, and black toner images. The image forming stations 1M, 1C, 1Y, and 1K are arranged vertically in FIG. 1, and a transfer unit 50 is provided on a side thereof.

The image forming stations 1M, 1C, 1Y, and 1K have a similar configuration except the color of toner used therein. Therefore, only the image forming station 1M is described below, and descriptions of other image forming stations 1C, 1Y, and 1K are omitted. The image forming station 1M includes a process unit 2M, an optical writing unit 10M, and a development device 20M.

The process unit 2M for magenta includes a drum-shaped photoreceptor 3M that rotates counterclockwise in FIG. 1, and, around the photoreceptor 3M, a charging unit 4M, a drum cleaning unit 5M, and a discharge lamp 6M are provided. These components are housed in a common unit casing as a single unit removably installable in the image forming apparatus 100. For example, the photoreceptor 3M serving as a latent image bearer includes an aluminum base pipe and an organic photosensitive layer overlying it.

The charging unit 4M uniformly charges a surface of the photoreceptor 3M that rotates counterclockwise in FIG. 1 to a negative polarity by corona charging.

The optical writing unit 10M includes a light source such as a laser diode, a polygon mirror that is a regular hexahedron, a polygon motor to rotate the polygon mirror, an f-θ lens, lenses, and reflection mirrors. The light source is driven according to image data transmitted from, for example, computers and emits a laser beam L. As the polygon mirror rotates, the laser beam L is reflected on the faces of the polygon mirror, thus deflected, and reaches the photoreceptor 3M. While the surface of the photoreceptor 3M is thus scanned optically, an electrostatic latent image is formed thereon.

Figure 2:
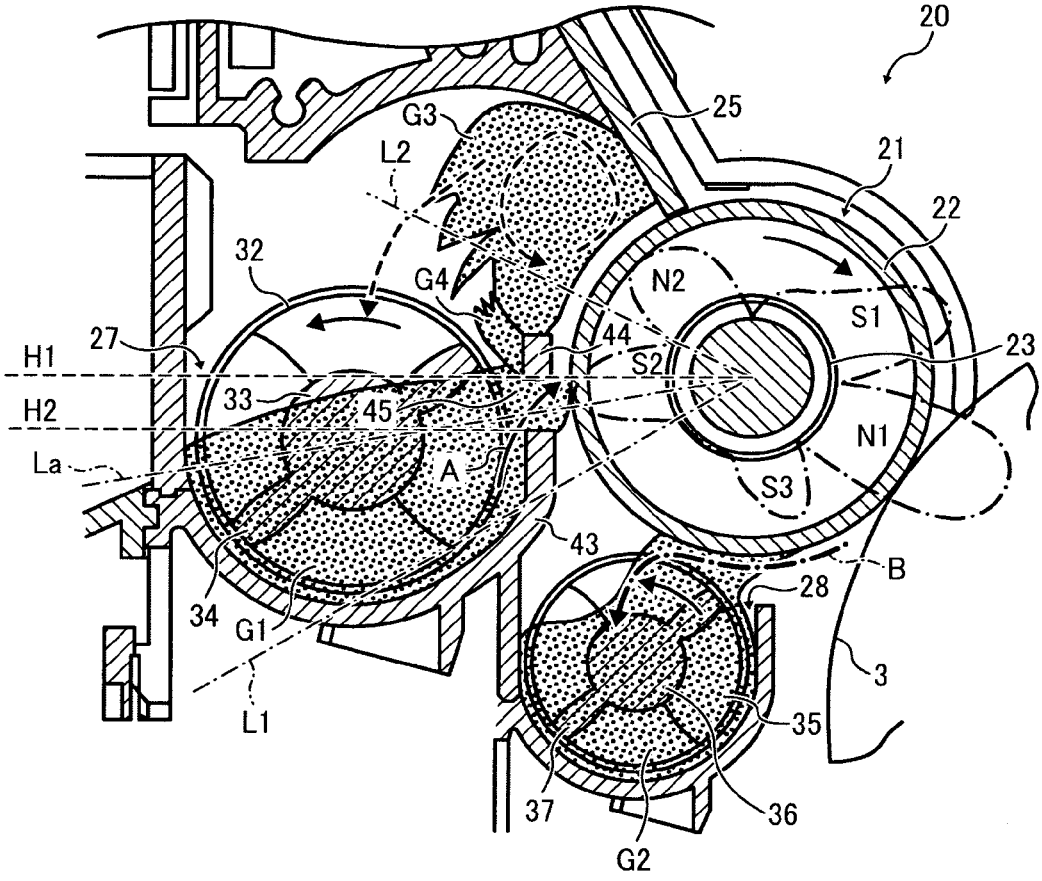
FIG. 2 is an end-on axial view of a development device included in the image forming apparatus shown in FIG. 1.

The development device 20M includes a casing in which an opening is formed and a development roller 21M that is exposed partially through the opening. The casing of the development device 20M contains magenta developer constituting essentially of magnetic carrier and magenta toner charged to a negative potential. Referring to FIG. 2, the development roller 21M includes a development sleeve 22, serving as a developer bearer, and a magnet roller 23, serving as a magnetic field generator, disposed inside the development sleeve 22. The development sleeve 22 may be a nonmagnetic hollow cylinder. In the present embodiment, the magnet roller 23 is held not to rotate as the development sleeve 22 rotates, driven by a driving unit. The development sleeve 22 is cylindrical, and the term "cylindrical" in this specification is not limited to round columns but also includes polygonal prisms.

The development device 20M further includes two conveyance screws (developer agitators), namely, a supply screw 32 and a collecting screw 35, to transport the magenta developer while agitating it to facilitate triboelectric charging thereof, and the magenta toner is adsorbed on a surface of the rotating development sleeve 22 of the development roller 21M by the magnetic force exerted by the magnet roller 23. The amount of the developer carried on the development sleeve 22 is adjusted by a doctor blade 25M as the rotating development sleeve 22 passes by the doctor blade 25M, after which the developer is carried to a development range facing the photoreceptor 3M.

A power source applies a development bias of negative polarity to the development sleeve 22, and, in the development range, a development potential acts between the development sleeve 22 and the electrostatic latent image formed on the photoreceptor 3M to transfer the magenta toner of negative polarity electrostatically from the development sleeve 22 to the latent image. By contrast, a non-development potential acts between the development sleeve 22 and the uniformly charged portions (background portion) of the photoreceptor 3M to transfer the magenta toner of negative polarity electrostatically from the photoreceptor 3M to the development sleeve 22. Thus, the magenta toner in the magenta developer carried on the development sleeve 22 is transferred by the effects of the development potential to the electrostatic latent image on the photoreceptor 3M, and the electrostatic latent image is developed into a magenta toner image. After the magenta toner therein is thus consumed, the magenta developer is returned from the development sleeve 22 inside the casing as the development sleeve 22 rotates.

The development device 20M further includes a toner concentration detector that in the present embodiment is a magnetic permeability sensor. The toner concentration detector outputs a voltage corresponding to the magnetic permeability of the magenta developer contained in a developer collection compartment 28, which is described later, provided in the development device 20M. Since the magnetic permeability of developer has a good correlation with the concentration of toner in the developer, the toner concentration detector outputs a voltage corresponding to the toner concentration. The value of the output voltage is transmitted to a toner supply controller. The toner supply controller includes a storage unit such as a random access memory (RAM) and stores target values Vtref for the output voltages from the toner concentration detectors respectively provided in the development devices 20M, 20C, 20Y, and 20K in the storage unit. For supplying magenta toner, the toner supply controller compares the voltage output from the magenta toner concentration detector with the target value Vtref for magenta and drives a magenta toner supply device for a time period corresponding to the comparison result. With this operation, fresh magenta toner is supplied to the developer collection compartment 28 in the development device 20M. By controlling the driving of the magenta toner supply device, toner is supplied as required to the magenta developer in which the toner concentration is decreased as the toner is consumed in image development, and the concentration of magenta toner in the magenta developer can be kept within a predetermined range. Similar toner supply control is performed in the development devices 20C, 20Y, and 20K.

Referring to FIG. 1, the magenta toner image developed on the photoreceptor 3M is transferred onto a front side of an intermediate transfer belt 51 of the transfer unit 50.

After the transfer process, the drum cleaning unit 5M removes any toner remaining on the surface of the photoreceptor 3M. Subsequently, the discharge lamp 6M removes the electrical potential remaining on the photoreceptor 3M, after which the charging unit 4M charges the surface of the photoreceptor 3M uniformly.

It is to be noted that, although the image forming station 1M for magenta is described above, also in other image forming stations 1C, 1Y, and 1K, cyan, yellow, and black toner images are respectively formed on the photoreceptors 3C, 3Y, and 3K through similar processes.

The transfer unit 50, positioned on the right of the vertically arranged image forming stations 1M, 1C, 1Y, and 1K in FIG. 1, further includes a driving roller 52, a tension roller 53, and a driven roller 54 disposed inside the loop of the endless intermediate transfer belt 51. The intermediate transfer belt 51 is stretched around the three rollers and is rotated clockwise ion FIG. 1 as the driving roller 52 rotates. A front side of a left portion of the intermediate transfer belt 51 extending vertically is in contact with the photoreceptors 3M, 3C, 3Y, and 3K, thus forming primary-transfer nips for magenta, cyan, yellow, and black therebetween.

Transfer chargers 55M, 55C, 55Y, and 55K are provided inside the loop of the intermediate transfer belt 51 in addition to the above-described three rollers. The transfer chargers 55M, 55C, 55Y, and 55K are positioned on the backsides of the respective primary-transfer nips and apply electrical charges to the back surface of the intermediate transfer belt 51. The electric charges thus applied to the intermediate transfer belt 51 generate transfer electric fields in the respective primary-transfer nips to transfer the toner electrostatically from the photoreceptors 3M, 3C, 3Y, and 3K to the front side of the intermediate transfer belt 51. It is to be noted that, instead of the corona charging transfer chargers, transfer rollers to which a transfer bias is applied may be used.

In the respective primary-transfer nips, the magenta, cyan, yellow, and black toner images are transferred primarily from the respective photoreceptors 3M, 3C, 3Y, and 3K and superimposed one on another on the front side of the intermediate transfer belt 51 due to the nip pressure and effects of the transfer electric field (primary transfer process). Thus, a superimposed four-color toner image is formed on the intermediate transfer belt 51.

Additionally, a secondary-transfer bias roller 56 is provided in contact with the front side of a portion of the intermediate transfer belt 51 winding around the driving roller 52, thus forming a secondary-transfer nip therebetween. A voltage application unit that includes a power source and wiring applies a secondary-transfer bias to the secondary-transfer bias roller 56, and thus a secondary-transfer electric field is generated between the secondary-transfer bias roller 56 and the driving roller 52 that is grounded. The four-color toner image formed on the intermediate transfer belt 51 is transported to the secondary-transfer nip as the intermediate transfer belt 51 rotates.

Additionally, the image forming apparatus 100 includes a sheet cassette for containing a bundle of recording sheets P. The recording sheets P contained in the sheet cassette are fed to a paper feeding path from the top at a predetermined timing. A pair of registration rollers 60 pressing against each other is provided downstream form the sheet cassette in a direction in which the recording sheet P is transported (hereinafter "sheet conveyance direction"), and the recording sheet P gets stuck in a nip between the registration rollers 60.

Although the pair of registration rollers 60 rotates to catch the recording sheet P in the nip, both rollers stop rotating immediately after catching a leading end of the recording sheet P. The recording sheet P is then transported to the secondary-transfer nip, timed to coincide with the four-color toner image formed on the intermediate transfer belt 51. In the secondary-transfer nip, the four-color toner image is transferred secondarily from the intermediate transfer belt 51 onto the recording sheet P at a time. Then, the four-color toner image becomes a full color toner image (hereinafter "multicolor toner image") on the while recording sheet P. Subsequently, the recording sheet P carrying the multicolor toner image is transported to a fixing device, where the multicolor toner image is fixed on the recording sheet P.

A belt cleaning unit 57 is provided downstream from the secondary-transfer nip in the sheet conveyance direction and presses against the driven roller 54 via the intermediate transfer belt 51 to remove any toner remaining on the intermediate transfer belt 51 after the secondary transfer process.

It is to be noted that the suffixes M, C, Y, and K attached to each reference numeral indicate only that components indicated thereby are used for forming magenta, cyan, yellow, and black images, respectively, and hereinafter may be omitted when color discrimination is not necessary.

FIG. 2 illustrates the development device 20 of the image forming station 1. In FIG. 2, a graph illustrating magnetic flux density in a direction normal to an outer circumferential surface of the magnet roller 23 is superimposed on an end-on axial view of the development device 20.

In FIG. 2, the drum-shaped photoreceptor 3 is positioned with its long axis (axial direction) perpendicular to the surface of the paper on which FIG. 2 is drawn. The developer supply compartment 27 and the developer collection compartment 28 (hereinafter simply "supply compartment 27" and "collection compartment 28") are formed in the casing of the development device 20, and developer is contained therein. In addition, the supply screw 32 is rotatably provided in the supply compartment 27, and the collecting screw 35 is rotatably provided in the collection compartment 28.

The development roller 21 is positioned with the circumferential surface of the development sleeve 22 partly exposed through the opening formed in the casing on the side facing the photoreceptor 3. On the side opposite the photoreceptor 3, the development sleeve 22 faces the supply compartment 27 as well as the collection compartment 28 over the substantially entire axial length of the development sleeve 22. The collection compartment 28 is positioned beneath the development roller 21. In the present embodiment, the supply compartment 27 is positioned on the side of the development roller 21, slightly lower than the development roller 21 in FIG. 2.

The supply screw 32 provided inside the supply compartment 27 is formed of a nonmagnetic material such as resin and extends horizontally similarly to the photoreceptor 3 and the development roller 21. The supply screw 32 includes a rotary shaft 33, which may be nonmagnetic resin or nonmagnetic metal, and spiral-shaped screw blade 34 projecting from the circumferential surface of the rotary shaft 33. The rotary shaft 33 and the screw blade 34 integrally rotate counterclockwise in FIG. 2, driven by a driving unit including a motor and a drive transmission system.

The collecting screw 35 provided inside the collection compartment 28 extends horizontally as well, similarly to the photoreceptor 3 and the development roller 21. The collecting screw 35 includes a rotary shaft 36 and spiral-shaped screw blade 37 formed of a nonmagnetic material such as resin, projecting from the circumferential surface of the rotary shaft 36. The rotary shaft 36 and the screw blade 37 integrally rotate counterclockwise in FIG. 2, driven by a driving unit.

Although partially separated by a partition 43 forming a side wall of the supply compartment 27 on the side of the development roller 21, the supply compartment 27 and the collection compartment 28 can communicate with each other through openings formed in either end portion of the partition 43 in the axial direction of the development roller 21. It is to be noted that reference numeral 44 shown in FIG. 2 denotes a shielding wall serving as a blocker.

In the supply compartment 27, the developer carried inside the screw blade 34 of the supply screw 32 (hereinafter "developer G1") is transported from the front to the back in the direction perpendicular to the surface of the paper on which FIG. 2 is drawn as the supply screw 32 rotates. While thus transported, the developer G1 overstrides an upper end of the partition 43 and is supplied to the development sleeve 22 sequentially as indicated by arrow A shown in FIG. 2. The developer G1 is then carried on the surface of the development sleeve 22 due to the magnetic force (i.e., attraction magnetic force) exerted by the magnet roller 23 inside the development sleeve 22. The developer G1 that is not supplied to the development sleeve 22 but is transported to a downstream end portion of the supply compartment 27 (on the backside of the paper on which FIG. 2 is drawn) in the direction in which the developer is transported (hereinafter "developer conveyance direction") therein falls to the collection compartment 28 through the opening formed in the partition 43.

As the development sleeve 22 rotates, the developer carried thereon (hereinafter "developer G2") is transported to the development range and is used in image development. Subsequently, the developer G2 is transported to a position facing the collection compartment 28 as the development sleeve 22 rotates. Then, separated from the surface of the development sleeve 22 by a repulsive magnetic field generated by the magnet roller 23, the developer G2 falls to the collection compartment 28 as indicated by broken arrow B shown in FIG. 2.

In the collection compartment 28, the developer G2 carried inside the screw blade 37 of the collecting screw 35 is transported from the back side to the front side of the paper on which FIG. 2 is drawn as the collecting screw 35 rotates. While the developer G2 is thus transported, the toner supply device supplies fresh toner to the collection compartment 28. In addition, in an upstream end portion (on the back side of the paper on which FIG. 2 is drawn) of the collection compartment 28 in the developer conveyance direction, the collection compartment 28 receives the developer from the supply compartment 27 through the opening in the partition 43. The developer is transported in the collection compartment 28 by the collecting screw 35 to a downstream end portion in the developer conveyance direction and carried upward to the supply compartment 27 through the opening formed in the partition 43.

In the present embodiment, the magnet roller 23 includes five magnetic poles N1, S1, N2, S2, and S3 arranged in that order in the direction opposite the direction in which the development sleeve 22 rotates as shown in FIG. 2. The magnetic poles N1 serves as a development pole for generating a development magnetic force to cause the developer carried on the development sleeve 22 to stand on end thereon. The magnetic pole S1 serves as a conveyance pole for generating a magnetic force to transport the developer carried on the development sleeve 22 to the development range.

The magnetic pole N2 serves as a regulation pole to generate a regulation magnetic force for causing the developer to stand on end on the development sleeve 22 when the developer passes through a regulation gap, which is a gap between the surface of the development sleeve 22 and the doctor blade 25 serving as a developer regulator. The magnetic pole S2 serves as an attraction pole or pump-up pole to generate a magnetic force for pumping up the developer onto the surface of the development sleeve 22. The magnetic pole S3 cooperates with the magnetic pole S2 to generate the repulsive magnetic field for separating the developer from the development sleeve 22 and collecting it in the collection compartment 28.

In the above-described image forming apparatus 100 according to the present embodiment, the four photoreceptors 3M, 3C, 3Y, and 3K serve as the latent image bearers to rotate and carry the latent image formed on the their surfaces. The optical writing units 10M, 10C, 10Y, and 10K serve as latent image forming units to form latent images on the respective photoreceptors 3 charged uniformly. Further, the development devices 20M, 20C, 20Y, and 20K develop the latent images formed on the photoreceptors 3M, 3C, 3Y, and 3K.

Next, a comparative development device is described below with reference to FIG. 8 that illustrates a first comparative development device 120.

The development device 120 is different from the development device 20 according to the first embodiment in that an upper end of a partition 143 is positioned higher than that of the partition 43 in the development device 20 and that the shielding wall 44 (blocker) is not provided. Components of the development device 120 similar to those of the development device 20 shown in FIG. 2 are given an identical reference numeral and a suffix "Z", and thus descriptions thereof are omitted.

In the comparative development device 120, the regulation magnetic force exerted by the regulation pole N2 acts on the developer G3 that has been prevented from passing through the regulation gap and retains the developer G3 in a retaining portion adjacent to and upstream from the doctor blade 25Z in the direction of rotation of the development sleeve 22Z. As the development sleeve 22Z rotates, the developer G3 retained in the retaining portion (hereinafter "retained developer G3") is circulated in the retaining portion in the direction opposite the direction of rotation of the development sleeve 22Z as indicated by broken arrow Y1. It is to be noted that it is possible that the retained developer G3 includes the developer G1 flipped up by the supply screw 32Z.

While retained by the regulation magnetic force and circulated in the retaining portion, the retained developer G3 is further electrically changed by sliding contact. As a result, the amount of charge of the toner (hereinafter "toner charge amount") in the retained developer G3 is remarkably higher than that of the developer G1 in the supply compartment 27Z. This causes a difference in development ability between the retained developer G3 and the developer G1 in the supply compartment 27Z. Even if the development ability is different, visible unevenness in image density is not caused as long as the developer G1 and the retained developer G3 are dispersed uniformly and mixed. The unevenness in image density, however, becomes visible if mixing of the developers G1 and G3 are insufficient, degrading the image quality.

In the comparative development device 120, the developer G3 escaped the restraint by the regulation magnetic force while being circulated is collected in the supply compartment 27Z. The developer G3 collected in the supply compartment 27Z can be sufficiently mixed with the developer G1 before pumped up to the development sleeve 22Z again, and thus the above-described degradation in image quality be prevented. However, the attraction pole S2 having the reverse polarity to that of the regulation pole N2 is positioned adjacent to and upstream from the regulation pole N2. Consequently, in the comparative development device 120, a magnetic field in which the magnetic force lines extending from the regulation pole N2 pass through the retaining portion and are curved toward the attraction pole S2 is formed. In such a magnetic field, a portion of the retained developer G3 closest to the attraction pole S2 (close to the upper end of the partition 143) moves to the attraction pole S2 along the magnetic force lines and then is attracted to the development sleeve 22Z. As a result, a part of the retained developer G3 is not collected in the supply compartment 27Z but is transported directly to the surface of the development sleeve 22Z.

At that time, when the amount of the developer G1 pumped up onto the development sleeve 22Z from the supply compartment 27Z is sufficient, the developer G3 attracted by the attraction magnetic force overlays the developer G1. In this case, because the developer G3 is positioned at the uppermost position, away from the surface of the development sleeve 22Z, the developer G3 is blocked by the doctor blade 25Z and does not pass through the regulation gap. Accordingly, the developer layer transported by the development range can contain the developer G1 only. Consequently, unevenness in image density and the degradation in image quality can be prevented or inhibited.

Figure 8:
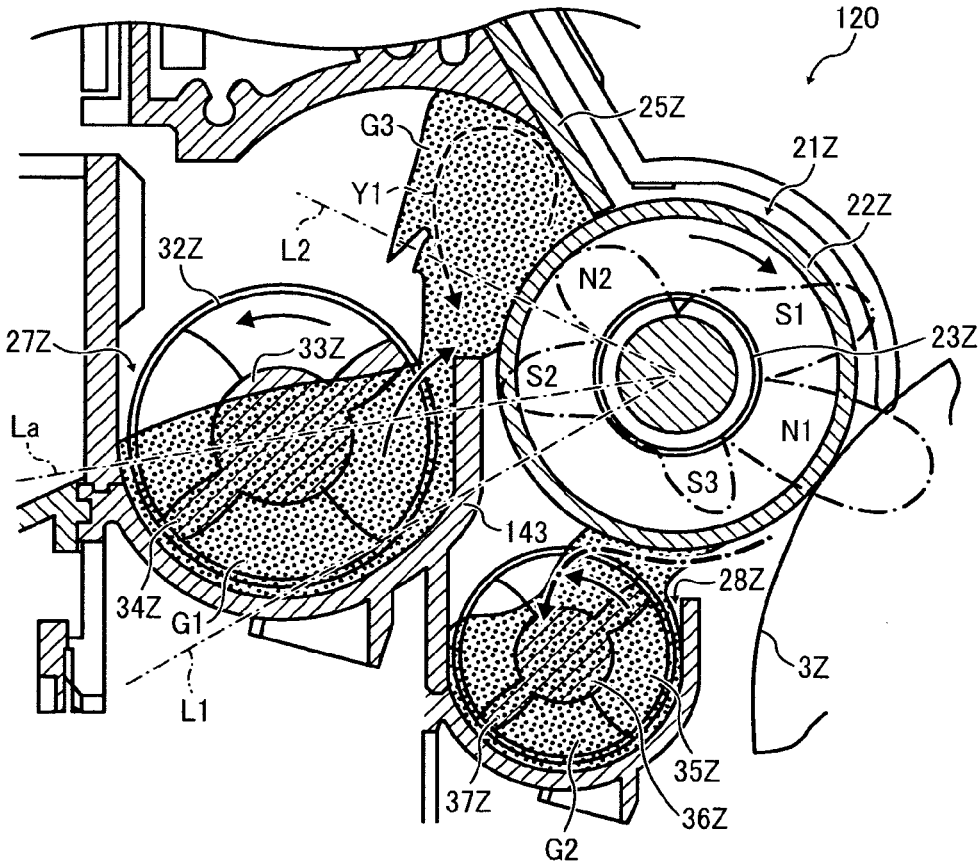
FIG. 8 illustrates a comparative development device that does not include the shielding wall.

However, in the comparative development device 120 shown in FIG. 8, the developer G3 attracted by the attraction magnetic force to the development sleeve 22Z hinders pumping up the developer G1 from the supply compartment 27Z. In particular, in a portion where the force of the screw blade 34Z conveying the developer G1 to the development sleeve 22Z is weaker (where outer circumferential portions of the screw blade 34Z do not pass by the development sleeve 22Z), the developer G1 supplied toward the development sleeve 22Z tends to be hindered by the developer G3 attracted by the attraction magnetic force. As a result, in such a portion, it is possible that the retained developer G3 attracted by the attraction magnetic force can be carried in an area adjacent to the surface of the development sleeve 22Z and transported through the regulation gap to the development range. Accordingly, in the developer layer conveyed to the development range, the developer G3 including the excessively charged toner and the developer G1 including the normally charged toner are not mixed sufficiently, which causes the unevenness in image density and the degradation in image quality.

In particular, the comparative development device 120 shown in FIG. 8 is supply-collection separation type, and the developer that has passed through the development range is collected in the collection compartment 28Z different from the supply compartment 27Z. In such development devices, the developer G1 in the supply compartment 27Z is pumped up onto the development sleeve 22Z and transported to the downstream end portion in the developer conveyance direction. This means that the amount of the developer G1 flowing in the supply compartment 27Z decreases toward downstream in the developer conveyance direction, and the possibility of shortage of the developer G1 supplied to the development sleeve 22Z increases in the downstream end portion in the developer conveyance direction (hereinafter "local shortage of the developer G1"). Therefore, pumping up the developer G1 tends to be hindered in the downstream end portion of the supply compartment 27Z in the developer conveyance direction by the developer G3 attracted by the attraction magnetic force, resulting in the unevenness in image density and degradation in image quality.

Therefore, as shown in FIG. 2, in the development device 20 according to the first embodiment, the partition 43 is reduced in height with its upper end positioned lower compared with the partition 143 of the comparative development device 120 shown in FIG. 8, and the shielding wall 44 is provided to inhibit the degradation in image quality. For example, the height (H2 shown in FIG. 2) of the upper end of the partition 43 is lower than the height (H1 shown in FIG. 2) of the center of rotation of the development roller 21. The shielding wall 44 is positioned to prevent the retained developer G3 blocked by the doctor blade 25 from moving toward the development sleeve 22 along the magnetic force lines of the regulation magnetic force.

The shielding wall 44 can prevent the retained developer G3 attracted by the attraction magnetic force from hindering pumping up the developer G1 from the supply compartment 27. Therefore, local shortage of the developer G1 pumped up from the supply compartment 27 can be prevented or restricted. Accordingly, the developer G3 attracted by the attraction magnetic force is less likely to pass through the regulation gap and be held in the portion adjacent to the surface of the development sleeve 22. Accordingly, the above-described developer layer in which the developer G3 including the excessively charged toner and the developer G1 including the normally charged toner are mixed insufficiently is not conveyed to the development range, thus restricting unevenness in the image density and the degradation of image quality.

Additionally, the shielding wall 44 is positioned across a slit 45 (supply gap) from the upper end of the partition 43 for allowing the developer G1 to move from the supply compartment 27 toward the development sleeve 22. More specifically, the slit 45 extends at least over the entire length of the development range in the axial direction of the development sleeve 22. Therefore, even in the configuration that includes the shielding wall 44, pumping up the developer G1 from the supply compartment 27 to the development sleeve 22 is not hindered. In particular, in the first embodiment, the slit 45 is positioned such that a straight line La (shown in FIG. 2) passing through a center of rotation of the development sleeve 22 as well as that of the supply screw 32 also passes through the slit 45 as viewed in the axial direction of the development sleeve 22. This configuration can minimize the distance by which the developer G1 is transported from the supply compartment 27 to be supplied to the surface of the development sleeve 22.

Figure 3:
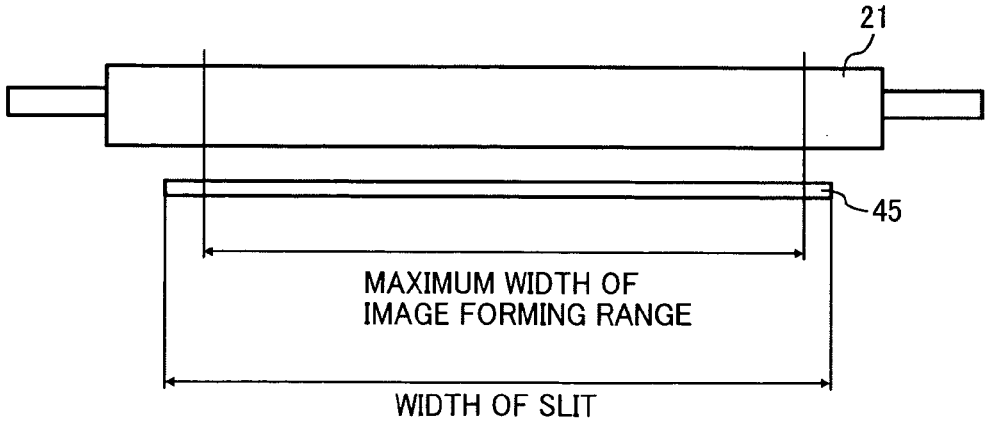
FIG. 3 illustrates the relation between a slit in the development device and the width of a maximum image forming range.

Additionally, as shown in FIG. 3, the slit 45 has a width (i.e., length in the axial direction of the development sleeve 22) greater than a width of the maximum image forming range in the first embodiment. If the slit 45 is narrower than the maximum image forming range in the axial direction of the development sleeve 22, it is possible that the developer G1 that has passed through the slit 45 and has moved in the axial direction of the development sleeve 22 can be carried on the axial end portions of the development sleeve 22 facing the end portions of the maximum image forming range in the axial direction of the development sleeve 22. Accordingly, the amount of the developer G1 carried on the surface of the development sleeve 22 tends to be insufficient in the end portions corresponding to the end portions of the maximum image forming range in the axial direction. Then, the shortage of the developer in such axial end portions of the development sleeve 22 is compensated by the retained developer G3 in the retaining portion. In this case, however, the image density becomes uneven between an axial center portion and the axial end portions, degrading the image quality, when images are formed using the entire maximum image forming range. Therefore, in the present embodiment, the length of the slit 45 is greater than that of the maximum image forming range in the axial direction of the development sleeve 22 to prevent or restrict the degradation in image quality.

The opening width, which is the length of the slit 45 in the rotational direction of the development sleeve 22 or the distance between the lower face of the shielding wall 44 to the upper face of the partition 43 in FIG. 2, is preferably 2 mm or greater. If the opening width of the slit 45 is shorter than 2 mm, it is difficult for the developer G1 to move through the slit 45 smoothly when the carrier particles have a volume average particle size of about 50 μm. A sufficient amount of developer G1 cannot be supplied to the surface of the development sleeve 22 if the developer G1 does not move through the slit 45 smoothly. Then, the retained developer G3 can be held in the portion where the amount of the developer G1 is insufficient and transported through the regulation gap to the development range. As a result, the image density can become uneven, degrading the image quality. By contrast, the slit 45 having an opening width of 2 mm or greater can secure smooth passage of the developer G1 through the slit 45 even when the carrier particles have a volume average particle size of about 50 μm. In particular, since the reduction in the particle diameter of carrier particles has progressed recently, using developer including small diameter carrier particles can ensure smooth passage of the developer G1 through the slit 45. Therefore, the image density can be kept uniform, and the image quality is not degraded.

Further, the regulation gap between the doctor blade 25 and the surface of the development sleeve 22 has a sufficient size for reliable supply of the predetermined amount of developer to the development range because fluctuations in the amount of developer supplied to the development range can affect the development ability significantly. If a shielding wall gap, meaning a distance between the surface of the development sleeve 22 and a portion of the shielding wall 44 closest to the development sleeve 22, is smaller than the regulation gap, the amount of developer carried on the development sleeve 22 and transported through the shielding wall gap is reduced from the amount of developer transported through the regulation gap. In such a case, even if the developer transported through the shielding wall gap includes only the developer G1 pumped up from the supply compartment 27 without the retained developer G3, the developer layer that passes through the regulation gap can include the retained developer G3 overlying the developer G1. If the retained developer G3 is dispersed uniformly in the developer layer that passes through the regulation gap, a uniform image density can be maintained, keeping a satisfactory image quality, even in this case. However, a desired image density cannot be attained when the ratio of the retained developer G3 having excessively charged toner particles is higher in the developer layer that contributes to image development in the development range.

In view of the foregoing, in the present embodiment, the shielding wall gap between the shielding wall 44 and the surface of the development sleeve 22 is similar or wider than the regulation gap in a portion where the shielding wall 44 is closest to the surface of the development sleeve 22. With this configuration, the developer layer that has passed through the shielding wall gap can pass through the regulation gap as is. That is, the developer layer that passes through the regulation gap can include only the developer G1 pumped up from the supply compartment 27, having normally charged toner particles. Therefore, the unevenness in the image density can be resolved or restricted.

Figure 9:
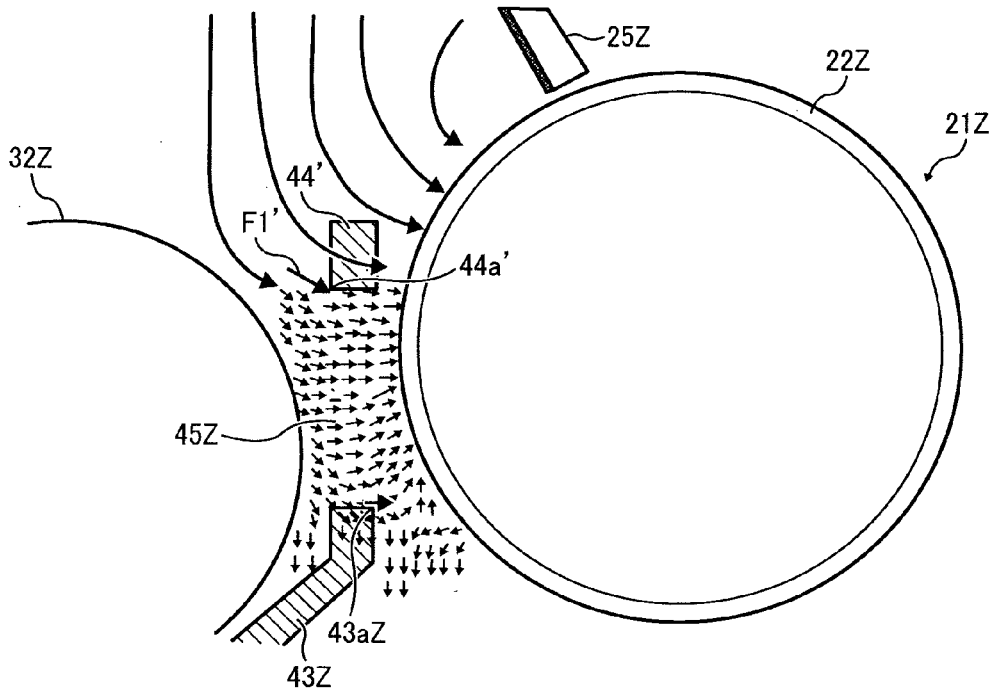
FIG. 9 illustrates another comparative development device in which the resultant of the magnetic force and the gravity acting on the magnetic carrier particle positioned at the lower edge of the shielding wall facing the supply compartment is inclined down from a horizontal plane.
Figure 10:
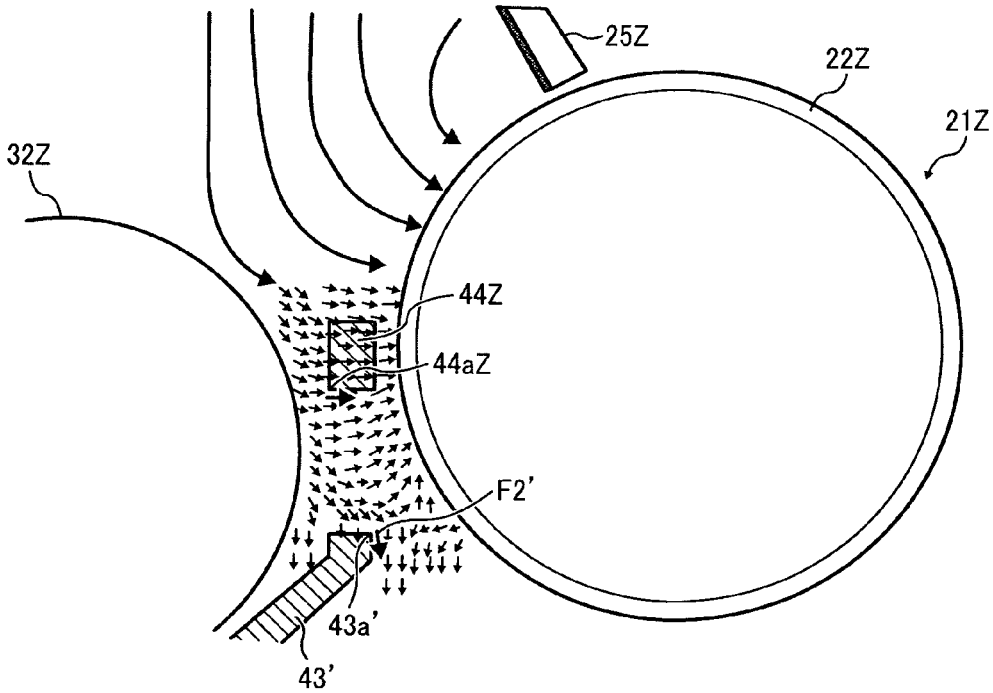
FIG. 10 illustrates another comparative development device in which the resultant of the magnetic force and the gravity acting on the magnetic carrier particle positioned at the upper edge of the partition facing the development sleeve is inclined down from the horizontal plane.
Figure 11:
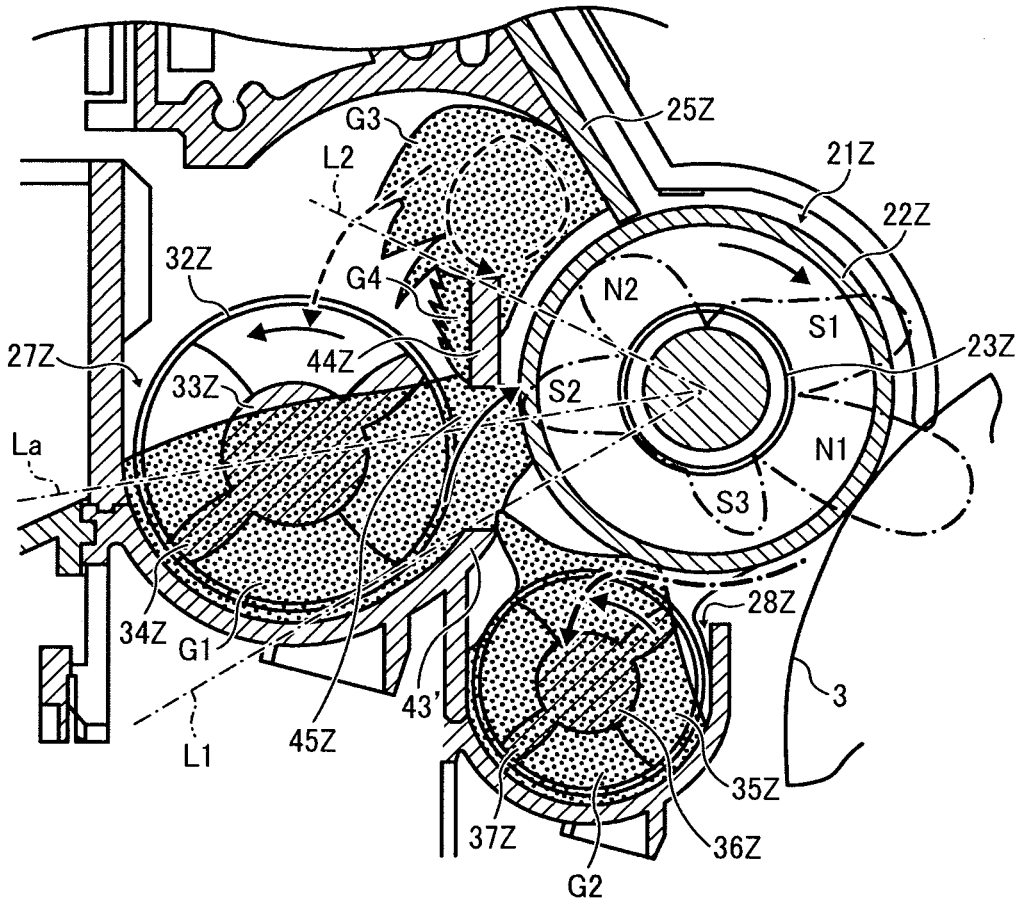
FIG. 11 illustrates another comparative development device, in which the height of the partition is reduced.

FIGS. 9, 10, and 11 respectively illustrate second, third, and fourth comparative development devices. It is to be noted that components of any of the development comparative devices shown in FIGS. 9 through 11 similar to those of the development device 20 shown in FIG. 2 are given an identical reference numeral and a suffix "Z" or "'", and only the differences from the development device 20 are described below.

Referring to FIG. 9, reference character 44*a*' designates an edge of the lower face of the shielding wall 44' facing the slit 45Z, and the edge 44*a*' is on the side closer to the supply compartment 27Z. If a resultant F1' of the magnetic force and the gravity acting on magnetic carrier positioned at the edge 44*a*' is inclined lower than the direction toward the slit 45Z, that is, a horizontal plane, the retained developer G3 is more likely to enter the slit 45Z. Then, it is possible that the shielding wall 44' cannot exert a sufficient effect for preventing the retained developer G3 from moving to the surface of the development sleeve 22Z along the magnetic force lines of the regulation magnetic force.

In view of the foregoing, referring to FIGS. 4 and 5, in the present embodiment, the shielding wall 44 and the magnet roller 23 are configured so that, when a single magnetic carrier particle (hereinafter also "first specific magnetic carrier") C1 is disposed at the edge 44*a* of the shielding wall 44 in a state in which no developer is present in the development device 20, a resultant F1 of the magnetic force $F1_M$ and the gravity $F1_G$ acting on the first specific magnetic carrier C1 positioned at the edge 44*a* is inclined away from the slit 45, that is, inclined upward or in parallel to a horizontal plane.

Figure 4:
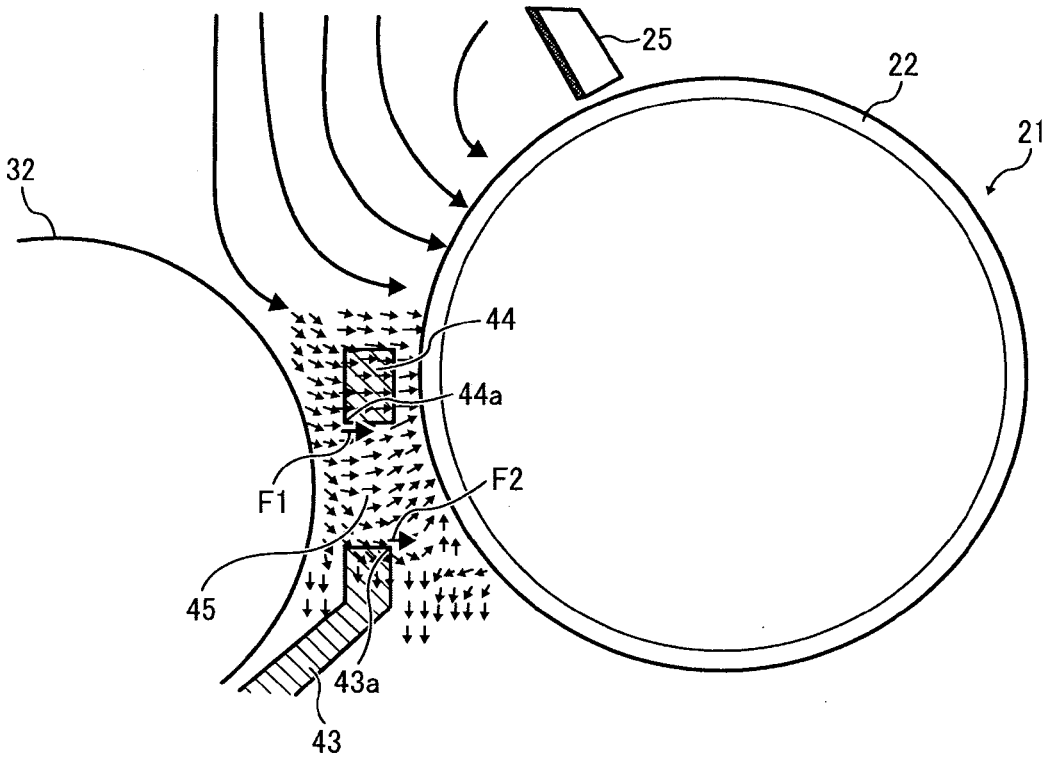
FIG. 4 illustrates the distribution and the direction of magnetic force at respective positions between a development sleeve and a supply screw when no developer is present in the development device.

FIG. 4 illustrates the distribution and the direction of magnetic force at respective positions between the development sleeve 22 and the supply screw 32 when no developer is present in the development device 20. It is to be noted that the length of each arrow indicating the direction of the magnetic force is independent of the strength of the magnetic force.

Figure 5:
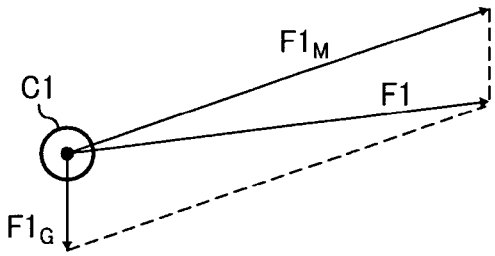
FIG. 5 illustrates the resultant of the magnetic force and the gravity acting on a single magnetic carrier particle positioned at a lower edge of a shielding wall facing a supply compartment.

FIG. 5 illustrates the resultant F1 of the magnetic force $F1_M$ and the gravity $F1_G$ acting on the single first specific magnetic carrier C1 positioned at the edge 44*a* facing the slit 45 and closer to the supply compartment 27.

The first specific magnetic carrier C1 positioned at the edge 44*a* does not enter the slit 45 unless an external force toward the slit 45 (in the present embodiment, the external force inclined downward from the horizontal plane) acts on the first specific magnetic carrier C 1. In the external force present at the edge 44*a*, the magnetic force $F1_M$ and the gravity $F1_G$ are dominant. In the present embodiment, as shown in FIGS. 4 and 5, because the resultant F1 of the magnetic force $F1_M$ and the gravity $F1_G$ acting on the first specific magnetic carrier C1 is inclined upward from the horizontal plane, the first specific magnetic carrier C1 can be prevented from entering the slit 45.

It is to be noted that, in practice, developer is present in the development device 20, and adjacent magnetic carrier particles are connected together with the magnetic force along the magnetic force line, forming chains of magnetic carrier particles. Therefore, the magnetic force component acting on the single magnetic carrier particle is stronger when the development device contains developer, and the magnetic force $F1_M$ increases relative to the gravity $F1_G$. Consequently, the resultant F1 is inclined upward further from the horizontal plane, further away from the slit 45. Therefore, in such a configuration that can prevent the first specific magnetic carrier C1 from entering the slit 45 when developer is not present in the development device 20, magnetic carrier particles present at the identical or similar position to that of the first specific magnetic carrier C1 do not enter the slit 45 in practice, that is, when developer is present in the development device 20. Further, in such a configuration that can inhibit the magnetic carrier particles present at the edge 44*a* from entering the slit 45, the retained developer G3 can be prevent from entering the slit 45 reliably.

Therefore, in the present embodiment, the retained developer G3 can be prevented effectively from going around the shielding wall 44 and entering the slit 45. Accordingly, the above-described developer layer in which the developer G3 including the excessively charged toner and the developer G1 including the normally charged toner are mixed insufficiently is not conveyed to the development range, thus restricting unevenness in the image density and the degradation of image quality.

It is to be noted that, to prevent the retained developer G3 from entering the slit 45 effectively, the lower end portion of the shielding wall 44 facing the slit 45 should be positioned upstream from a straight line L2 (shown in FIG. 2) passing through a polarity change point between the attraction pole S2 and the regulation pole N2 and the center of rotation of the development sleeve 22 in the rotational direction of the development sleeve 22.

In addition, in the first embodiment, as shown in FIG. 2, the shape and position of the shielding wall 44 as well as the configuration of the magnet roller 23 are designed so that developer G4 is attracted by the attraction magnetic force to a surface of the shielding wall 44 facing the supply compartment 27. In this configuration, the developer G4 standing on end on the shielding wall 44 due to the attraction magnetic force can form a wall to block the movement of the retained developer G3 attracted by the attraction magnetic force toward the slit 45. More specifically, the position and the thickness of the shielding wall 44 are designed so that the magnetic force for attracting the developer toward the development sleeve 22 can acts on the surface of the shielding wall 44 facing the supply compartment 27.

Consequently, in the present embodiment, the retained developer G3 can be prevented effectively from passing through the slit 45. Accordingly, the above-described developer layer in which the developer G3 including the excessively charged toner and the developer G1 including the normally charged toner are mixed insufficiently is not conveyed to the development range, thus restricting unevenness in the image density and the degradation of image quality.

It is to be noted that the above-described effect can be also attained by changing the shape of the shielding wall 44 so that the shielding wall 44 itself can function as the wall constituted of the developer G4 standing on end on the shielding wall 44. In this case, however, the shielding wall 44 increases in size, making it difficult to dispose the shielding wall 44 in the limited space between the development sleeve 22 and the supply screw 32. Accordingly, a higher degree of accuracy is required in the dimension of the components and assembling, thus increasing the cost. Therefore, causing the developer G4 standing on end on the shielding wall 44 to form the wall is advantageous in terms of cost.

Further, typically, in the downstream end portion of the supply compartment 27 in the developer conveyance direction, the amount of the developer G1 tends to be smaller, and the amount of developer supplied from the supply compartment 27 to the development sleeve 22 tends to be insufficient as described above. In the present embodiment, to address this inconvenience, the height of the partition 43 is reduced from that in the comparative development device 120 shown in FIG. 8. With this configuration, even when the amount of the developer G1 present in the supply compartment 27 is so small that the shortage of the developer supplied to the development sleeve 22Z arises in the comparative development device 120, the shortage of the supplied toner can be prevented in the present embodiment in which the height of the partition 43 is reduced. Accordingly, even in the downstream end portion of the supply compartment 27 in the developer conveyance direction, the above-described developer layer in which the developer G3 including the excessively charged toner and the developer G1 including the normally charged toner are mixed insufficiently is not conveyed to the development range, thus restricting unevenness in the image density and the degradation of image quality.

The attraction magnetic force, however, might fail to catch the developer G1 that has overstridden the upper end of the partition 43, letting the developer to fall, if the height of the partition 43 is excessively low. This is described in further detail below with reference to FIG. 10 that illustrates the third comparative development device.

Referring to FIG. 10, if a resultant F2' of the magnetic force and the gravity acting on the magnetic carrier positioned at an upper edge 43*a*' of the partition 43' on the side of the development sleeve 22Z is inclined downward from the horizontal direction, the developer G1 that has overstridden the upper end of the partition 43' escapes from the attraction magnetic force and drops. If the developer G1 thus drops, the amount of the developer supplied from the supply compartment 27Z to the development sleeve 22Z becomes insufficient, allowing the retained developer G3 pumped up by the attraction magnetic force to go around the lower end of the shielding wall 44Z. As a result, it is possible that the retained developer G3 is carried in a portion closer to the surface of the development sleeve 22 that can pass through the regulation gap.

Figure 6:
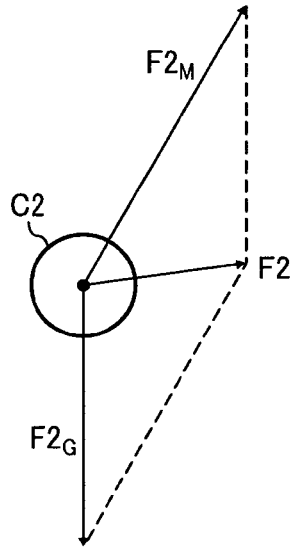
FIG. 6 illustrates the resultant of the magnetic force and the gravity acting on a single magnetic carrier particle positioned at an upper edge of a partition facing the development sleeve.

In view of the foregoing, referring to FIGS. 4 and 6, in the present embodiment, the partition 43 and the magnet roller 23 are configured so that, when a single magnetic carrier particle (hereinafter "second specific magnetic carrier") C2 is disposed at the edge 43*a* of the partition 43, which faces the development sleeve 22, in a state in which no developer is present in the development device 20, a resultant F2 of the magnetic force $F2_M$ and the gravity $F2_G$ acting on the second specific magnetic carrier C2 positioned at the edge 43*a* is inclined upward or in parallel to the horizontal direction. In this configuration, the second specific magnetic carrier C2 can be pumped up by the attraction magnetic force $F2_M$ to the surface of the development sleeve 22 against the gravity $F2_G$. Thus, the second specific magnetic carrier C2 does not drop. It is to be noted that, in practice, developer is present in the development device 20, and adjacent magnetic carrier particles are connected together with the magnetic force along the magnetic force line, forming chains of magnetic carrier particles. Therefore, the magnetic force component acting on the single magnetic carrier particle is stronger when the development device contains developer. Accordingly, the magnetic force $F2_G$ increases relative to the gravity $F2_G$, and the resultant F2 is inclined upward further from the horizontal plane. Therefore, under such conditions that can prevent the second specific magnetic carrier C2 from dropping when developer is not present in the development device 20, magnetic carrier particles present at the identical or similar position to that of the second specific magnetic carrier C2 do not drop in practice, that is, when developer is present in the development device 20.

In addition, because a stronger attraction magnetic force $F2_M$ is exerted on magnetic carrier particles positioned closer to the surface of the development sleeve 22 than the edge 43*a*, that is, positioned between the edge 43*a* and the development sleeve 22, than the magnetic force exerted on the magnetic carrier positioned at the edge 43*a*, such magnetic particles do not drop under such conditions that can prevent the second specific magnetic carrier C2 from dropping. Moreover, because magnetic carrier particles positioned vertically above the edge 43*a* are closer to a peak point of the magnetic flux density of the attraction pole S2 in a normal line direction than the magnetic carrier positioned at the edge 43*a*, a stronger attraction magnetic force $F2_M$ is exerted on such magnetic carrier particles than that exerted on the magnetic carrier at the edge 43*a*. Accordingly, other magnetic carrier particles can be prevented from dropping under conditions that can prevent the second specific magnetic carrier C2 at the edge 43*a* from dropping. It is to be noted that magnetic carrier particles positioned above the peak point of the attraction pole S2 in the normal line direction are supported by the magnetic carrier particles positioned under them and can be prevented from dropping.

Therefore, the developer G1 that has overstridden the upper end of the partition 43 can be prevented from escaping the attraction magnetic force and dropping in the development device 20 according to the present embodiment configured so that, in a state in which no developer is present in the development device 20, the resultant F2 of the magnetic force $F2_M$ and gravity $F2_G$ acting on the second specific magnetic carrier C2 positioned at the edge 43*a*, which faces the development sleeve 22, is inclined upward or in parallel to the horizontal direction.

Further, referring to FIG. 11, if the height of the partition 43' is excessively low, it is possible that the developer G2 used in image development (hereinafter "used developer G2") that is separated from the surface of the development sleeve 22Z by the repulsive magnetic field generated by the magnet roller 23Z can overstride the partition 43' and reach the supply compartment 27Z. Because the toner contained in the developer is consumed in the development range, the concentration of toner in the used developer G2 is reduced. If the used developer G2 moves to the supply compartment 27Z and is supplied to the development sleeve 22Z, the developer G1 having a standard toner concentration, pumped up from the supply compartment 27Z, and the developer G2 having a reduced toner concentration, which are not mixed sufficiently, can pass through the regulation gap and be used in image development. In this case, the image density can become uneven, degrading the image quality. Thus, the partition 43 should have a height sufficient for preventing the used developer G2 from moving to the supply compartment 27. Therefore, the upper end of the partition 43 is positioned downstream in the rotational direction of the development sleeve 22 from a release portion where a release magnetic force for separating the used developer G2 from the development sleeve 22 acts. More specifically, for example, the upper end of the partition 43 is positioned downstream in the rotational direction of the development sleeve 22 from a straight line L1 (shown in FIG. 2) passing through a polarity change point between the attraction pole S2 and the magnetic pole S3 and the center of rotation of the development sleeve 22.

It is to be noted that, in the first embodiment, the attraction pole S2 and the regulation pole N2 are adjacent to each other in the rotational direction of the development sleeve 22. In other words, no magnetic pole is present between the attraction pole S2 and the regulation pole N2. With this configuration, the developer particles carried on the development sleeve 22 between the attraction pole S2 and the regulation pole N2 do not stand on end but lie thereon along the magnetic force lines extending from the attraction pole S2 and the regulation pole N2. Lying developer particles can be densely carried on the development sleeve 22. Accordingly, even if attracted to the surface of the development sleeve 22 strongly between the attraction pole S2 and the regulation pole N2, the retained developer G3 just overlies the developer G1 supplied from the supply compartment 27 and does not push away the developer G1 to approach the surface of the development sleeve 22. Therefore, mixing the retained developer G3 in the developer that passes through the regulation gap can be restricted, and only the developer G1 having a standard toner charge amount can be used in image development.

Figure 12:
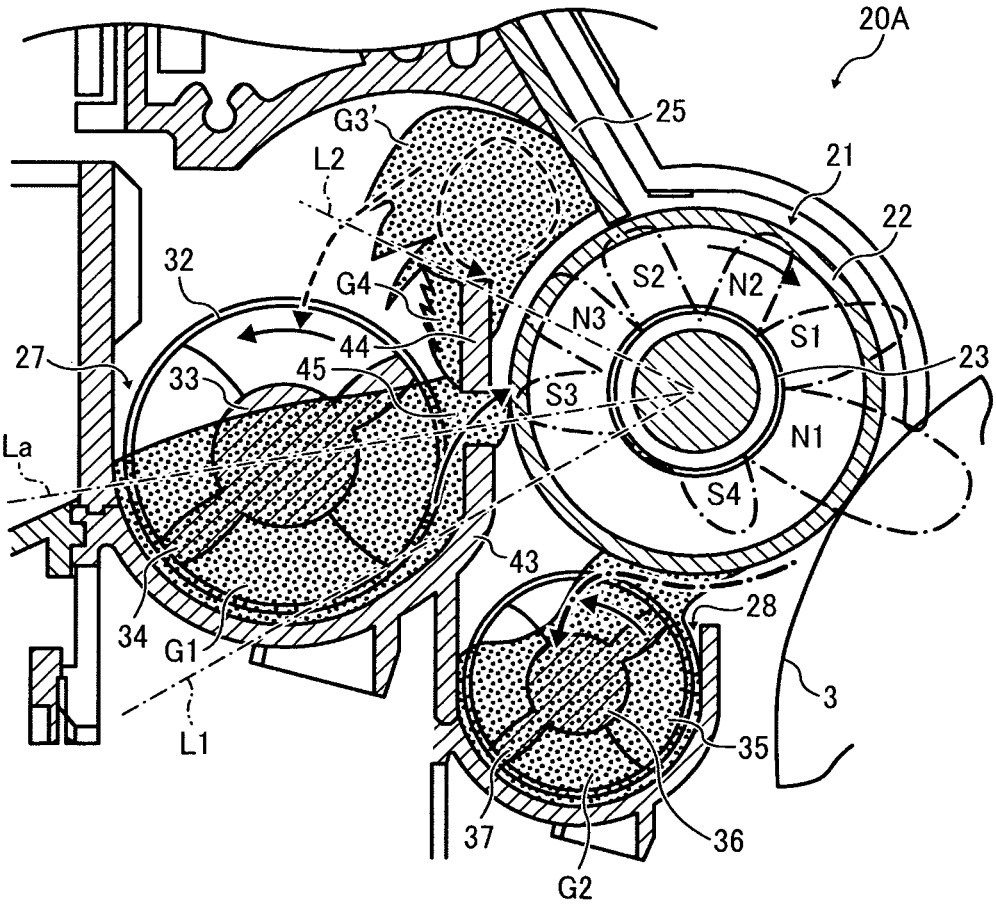
FIG. 12 illustrates another comparative development device, in which an intermediate magnetic pole having the opposite polarity is present between an attraction pole and a regulation pole.

Herein, referring to FIG. 12, in another comparative development device 20A, in which an intermediate magnetic pole N3 having the opposite polarity is present between the attraction pole S3 and the regulation pole S2, the magnetic force acts on the developer G3' along the magnetic force lines between the intermediate magnetic pole N3 and the regulation pole S2, thus retaining the developer G3'. In other words, the retained developer G3' is attracted to not a portion of the development sleeve 22 facing the attraction pole S3 but a portion of the development sleeve 22 facing the intermediate magnetic pole N3. Consequently, the portion where the retained developer G3' is attracted to the surface of the development sleeve 22 is deviated significantly downstream in the rotational direction of the development sleeve 22 from the portion where the developer G1 is pumped up from the supply compartment 27. Therefore, the retained developer G3' is less likely to hinder pumping up the developer G1 to the development sleeve 22 from the supply compartment 27. Thus, in such a configuration in which the intermediate magnetic pole N3 is provided, the likelihood of the degradation in image quality resulting from uneven image density is lower.

Moreover, such development devices as shown in FIG. 12 have other factors to reduce the likelihood of uneven image density due to the retained developer G3' and the degradation in image quality resulting from it. More specifically, because the magnetic chains of the developer particles carried on the development sleeve 22 conform to the magnetic force lines, the developer particles stand on end thereon in portions facing the respective magnetic poles and lie thereon in a portion between the adjacent magnetic poles. Therefore, the developer particles, most of which are pumped up from the supply compartment 27, carried on the surface of the development sleeve 22 stand on end thereon in the portion facing the intermediate magnetic pole N3 positioned between the attraction pole S3 and the regulation pole S2, and thus the developer particles are sparse. Then, the standing developer G1 lies on the development sleeve 22 while passing through an intermediate portion between the intermediate magnetic pole N3 and the regulation pole S2 as the development sleeve 22 rotates. With a sequence of the actions of the developer G1 described above, the retained developer G3' can be distributed uniformly in the developer G1 carried on the development sleeve 22, and the developer G3' retained in the retaining portion is consumed sequentially. Accordingly, the developer can be inhibited from remaining in the retaining portion a long time, and the degradation in image quality is small even if the retained developer G3' mixed in the developer G1 is supplied to the development range.

Use of the retained developer G3', however, is not preferable because the toner charge amount of the retained developer. G3' is higher compared with that of the toner contained in the developer G1 pumped up from the supply compartment 27. The development device 20 according to the present embodiment is advantageous over the configuration shown in FIG. 12 in terms of the charge amount of toner as described above. In addition, the magnetic pole arrangement can be simple.

Second Embodiment

A development device according to a second embodiment is described below. For example, the electrophotographic image forming apparatus in which the development device is incorporated is a printer.

Although the development device 20 in the above-described first embodiment includes only a single developer bearer (i.e., development sleeve 22), the present invention can adapt to multistage development devices that include multiple developer bearers disposed facing the photoreceptor 3 for developing the electrostatic latent image formed on the photoreceptor 3 in multiple steps.

It is to be noted that only the differences from the above-described first embodiment are described below, and descriptions of similar portions are omitted.

Figure 7:
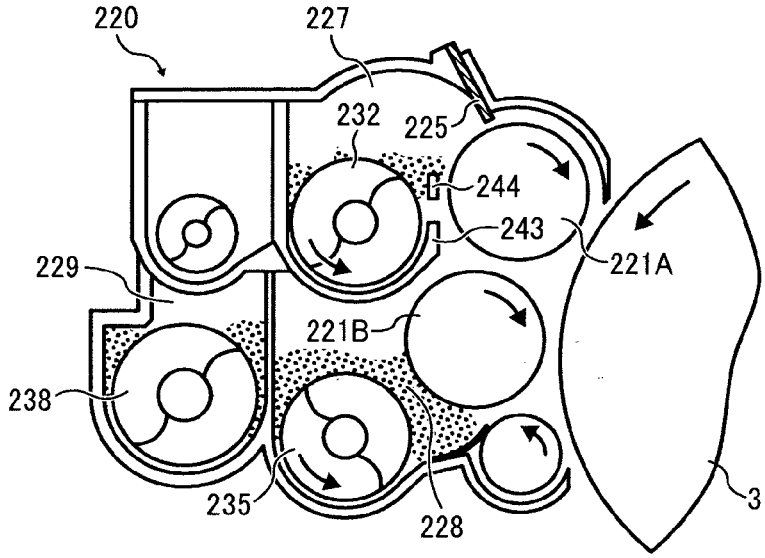
FIG. 7 is an enlarged end-on axial view of a development device according to another embodiment.

FIG. 7 is an enlarged end-on axial view of a development device 220 according to the second embodiment.

The development device 220 according to the second embodiment is multistage development type and includes first and second developer bearers, namely, first and second development rollers 221A and 221B. The development rollers 221A and 221B are positioned adjacent to and facing the circumferential surface of the photoreceptor 3, and the portion where the development rollers 221A and 221B face the photoreceptor 3 serves as the development range. In the development range, the developer particles standing on end on the development rollers 221A and 221B form magnetic brushes and contact the surface of the photoreceptor 3. The development device 220 contains two-component developer including toner particles T and carrier particles C. The development device 220 develops the electrostatic latent image formed on the photoreceptor 3 into a toner image.

The development device 220 in the present embodiment is premix development type, and fresh developer G is supplied from a developer cartridge as required, and degraded developer (i.e., waste developer) is discharged outside the development device 220 to a waste developer container. The developer cartridge contains premixed developer including toner (toner particles) T and carrier (carrier particles) C to be supplied to the development device 220. The development device 220 includes a magnetic detector to detect the concentration of toner in the developer G in the development device 220, and the developer G is supplied from the developer cartridge to the development device 220 in response to the toner concentration detected by the magnetic sensor detector. The ratio of the toner T to the carrier C in the developer G contained in the developer container is relatively high.

The casing and interior of the development device 220 form three developer conveyance compartments 227, 228, and 229 (also "a supply compartment 227, a collection compartment 228, and an agitation compartment 229"). Conveyance screws 232, 235, and 238 are provided in the developer conveyance compartments 227, 228, and 228, respectively. Each of the conveyance screws 232, 235, and 238 includes a shaft and a screw blade projecting from the screw shaft and transports the developer G contained inside the development device 220 in its axial direction, that is, the longitudinal direction of the development device 220. While being transported in the longitudinal direction by the conveyance screw 232 (hereinafter also "supply screw 232"), the developer G in the supply compartment 227 is sequentially pumped up to the surface of the first development roller 221A. The conveyance screw 235 (hereinafter also "collecting screw 235") is positioned vertically beneath the supply screw 232. After used in image development, the developer G carried on the second development roller 221B is separated therefrom, collected in the collection compartment 228, and transported therein by the collecting screw 235 in the longitudinal direction. The supply screw 232 and the collecting screw 235 are positioned with their axes of rotation in parallel to those of the development rollers 221A and 221B.

The conveyance screw 238 (also "agitation screw 238") is positioned oblique to the supply screw 232 as well as the collecting screw 235 to linearly connect a downstream end portion of the collection compartment 228 and an upstream end portion of the supply compartment 227 in the developer conveyance direction. The agitation screw 238 transports the developer G transported from the collecting screw 235 to the upstream portion of the supply compartment 227 in the developer conveyance direction. In addition, the developer G transported by the supply screw 232 to the downstream end portion of the supply compartment 227 falls to the collection compartment 228 and then is returned to the upstream end portion of the supply compartment 227 by the agitation screw 238.

Next, image formation performed on the photoreceptor 3 in the second embodiment is described below.

As the photoreceptor 3 is rotated counterclockwise in FIG. 7, the charging unit 4 charges the surface of the photoreceptor 3 uniformly. Subsequently, the optical writing unit 10 exposes the charged surface of the photoreceptor 3 with a light beam, thus forming an electrostatic latent image thereon. The surface of the photoreceptor 3 where the electrostatic latent image is formed is further transported to the position facing the development device 220. The electrostatic latent image formed on the photoreceptor 3 sequentially comes into contact with the magnetic brushes formed on the development rollers 221A and 221B, and the toner particles T in the magnetic brushes adhere to the electrostatic latent image, developing it into a toner image.

More specifically, a doctor blade 225 adjusts the amount of the developer G pumped up to the first development roller 221A, which is positioned in an upper portion in the development device 220. Then the developer G is transported to a first development range facing the photoreceptor 3. In the first development range, the developer G stands on end on the first development roller 221A due to the magnetic force exerted by a development magnetic pole of the first development roller 221A. Then the magnetic brush thus formed slides on the surface of the photoreceptor 3. At that time, the toner T in the developer G selectively adheres to only an image portion on the photoreceptor 3 due to a development magnetic field generated by a predetermined development bias applied to the first development roller 221A from a power source, and thus a toner image is formed.

After passing through the first development range, the developer G carried on the first development roller 221A is further transported to a developer receiving area facing a developer receiving magnetic pole inside the second development roller 221B as the first development roller 221A rotates. In the developer receiving area, the developer G is partly or entirely transferred from the first development roller 221A to the second development roller 221B and carried thereon due to the magnetic force exerted by the developer receiving magnetic pole. The developer G carried on the second development roller 221B is transported to a second development range facing the photoreceptor 3.

In the second development range, the developer G stands on end on the second development roller 221B due to the magnetic force exerted by a development magnetic pole of the second development roller 221B. Then the magnetic brush thus formed slides on the surface of the photoreceptor 3. At that time, the toner T in the developer G selectively adheres to only the image portion on the photoreceptor 3 due to a development magnetic field generated by a predetermined development bias applied to the second development roller 221B from the power source, and thus complementing the toner image. After passing through the second development range, the developer G carried on the second development roller 221B is separated from the second development roller 221B and is returned inside the development device 220.

The image portion on the surface of the photoreceptor 3 on which the toner image is formed in the first and second development ranges is subjected to image forming processes similar to those in the above-described first embodiment.

The development device 220 according to the second embodiment further includes the shielding wall (i.e., a shielding wall 244) serving as the blocker similarly. The shielding wall 244 is positioned to prevent the retained developer G3 that has been blocked by the doctor blade 225 from moving toward the first development roller 221A along the magnetic force lines of the regulation magnetic force. Therefore, similarly to the above-described first embodiment, the shielding wall 244 can prevent the retained developer G3 attracted by the attraction magnetic force from hindering pumping up the developer G1 from the supply compartment 227. Therefore, the local shortage of the developer G1 pumped up from the supply compartment 227 can be prevented or restricted. Accordingly, the developer G3 attracted by the attraction magnetic force is less likely to pass through the regulation gap and be held in the portion adjacent to the surface of the first development roller 221A. Accordingly, the above-described developer layer in which the developer G3 including the excessively charged toner and the developer G1 including the normally charged toner are mixed insufficiently is not conveyed to the development range, thus restricting the unevenness in image density and the degradation of image quality.

Third Embodiment

A development device according to a third embodiment is described below. For example, the image forming apparatus in which in the development device according to the present embodiment is incorporated is a printer.

Although the description below concerns a multistage development device 320 including multiple developer bearers disposed facing the photoreceptor 3 for developing the electrostatic latent image formed on the photoreceptor 3 in multiple steps similarly to the second embodiment, features of the third embodiment can adapt to development devices including only a single developer bearer (i.e., development sleeve 22) as in the above-described first embodiment.

It is to be noted that only the differences from the above-described second embodiment are described below, and descriptions of similar portions are omitted.

Figure 13:
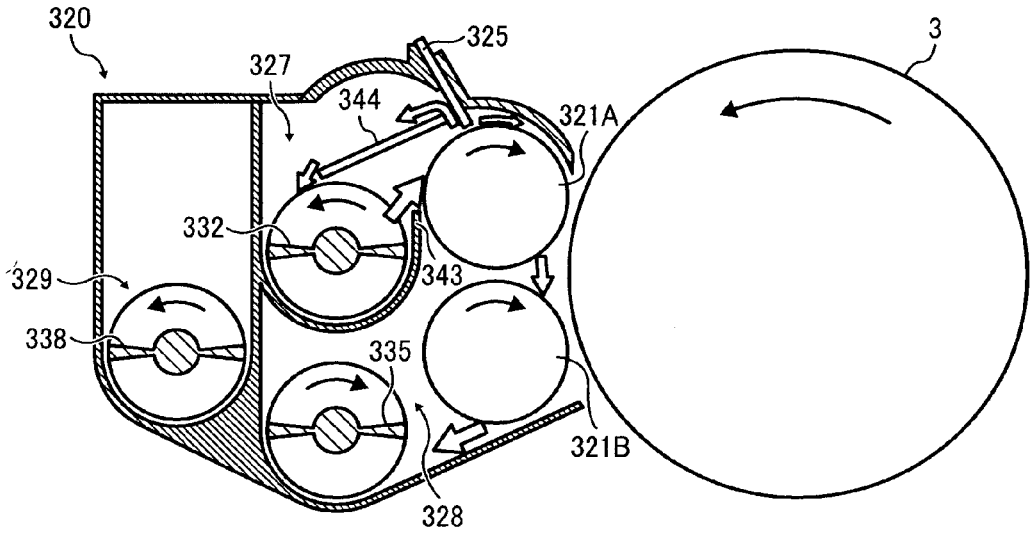
FIG. 13 is an enlarged end-on axial view of a development device according to another embodiment.

FIG. 13 is an enlarged end-on axial view of the development device 320 according to the third embodiment.

The development device 320 according to the third embodiment is multistage development type and includes first and second developer bearers, namely, first and second development rollers 321A and 321B. The casing and interior of the development device 320 form three developer conveyance compartments 327, 328, and 329 (also "a supply compartment 327, a collection compartment 328, and an agitation compartment 329") similarly to the second embodiment. Conveyance screws 332, 335, and 338 are provided in the developer conveyance compartments 327, 328, and 329, respectively. Each of the conveyance screws 332, 335, and 338 includes a shaft and a screw blade projecting from the screw shaft and transports the developer G contained inside the development device 320 in its axial direction.

The conveyance screw 332 (hereinafter also "supply screw 332") provided in the supply compartment 327 transports the developer G in the supply compartment 327 in the longitudinal direction of the development device 320. As shown in FIG. 13, the supply screw 332 rotates so that the screw blade thereof moves upward at a circumference of the supply screw 332 facing the first development roller 321A. The developer G contained in the supply compartment 327 receives a force from the supply screw 332 in the direction in which the screw blade thereof moves (i.e., rotational direction of the supply screw 332) in addition to the axial direction of the supply screw 332. Therefore, the developer in the supply compartment 327 moves in the rotational direction of the supply screw 332 around the shaft thereof while moving along the shaft of the supply screw 332. In addition, the transport force of the supply screw 332 in its rotational direction causes the level of the developer higher in a portion close to the first development roller 321A from the shaft of the supply screw 332 than that in the other portion away from the first development roller 321A. In other words, in the supply compartment 327, the developer is piled up higher on the upstream side than on the downstream side in the rotational direction of the supply screw 332. Then, the developer in the supply compartment 327 is supplied to the first development roller 321A from the side close to the first development roller 321A (i.e., upstream side in the rotational direction of the supply screw 332).

The development device 320 according to the third embodiment further includes the shielding wall (i.e., a shielding wall 344) serving as the blocker similarly. The shielding wall 344, however, is different from those in the above-described first and second embodiments in that the shielding wall 344 is configured not only to prevent the retained developer that has been blocked by the doctor blade 325 from moving toward the first development roller 321A along the magnetic force lines of the regulation magnetic force but also to guide the retained developer to the portion away from the first development roller 321A (downstream portion) on the developer surface in the supply compartment 327 in the rotational direction of the supply screw 332. For example, the distance between the first development roller 321A and the shielding wall 344 are designed so that the blocked developer can be carried on the shielding wall 344, and the shielding wall 344 is inclined from the horizontal plane so that the developer thereon can slip down or be pushed out to the portion of the supply compartment 327 away from the first development roller 321A in the rotational direction of the supply screw 332.

Therefore, the shielding wall 344 is capable of returning the retained developer to the downstream portion of the supply compartment 327 in the rotational direction of the supply screw 332 in addition to preventing the retained developer G3 attracted by the attraction magnetic force from hindering pumping up the developer G1 from the supply compartment 327 similarly to the above-described second embodiment.

If the retained developer is returned in the portion of the supply compartment 327 close to the first development roller 321A in the rotational direction of the supply screw 332, it is possible that the retained developer is supplied to the first development roller 321A before sufficiently mixed with the other developer present in the supply compartment 327. The insufficient mixing of the developer can make the image density uneven, degrading the image quality.

By contrast, when the retained developer is returned to the portion of the supply compartment 327 away from the first development roller 321A in the rotational direction of the supply screw 332 as in the present embodiment, the retained developer can move in the rotational direction of the supply screw 332 around the shaft of the supply screw 332 while moving along the shaft of the supply screw 332. Therefore, the retained developer returned to the supply compartment 327 can go down inside the supply compartment 327, pass below the shaft of the supply screw 322, and then reach the upstream portion of the supply compartment 327 in the rotational direction of the supply screw 332, after which the retained developer is supplied to the first development roller 321A. Thus, the retained developer can be mixed with the other developer in the supply compartment 327 sufficiently before supplied to the first development roller 321A. Therefore, the above-described unevenness in the image density can be restricted.

(First Variation)

Next, a variation of the development device according to the above-described first embodiment is described below (hereinafter "first variation") with reference to FIGS. 14 and 16.

Figure 14:
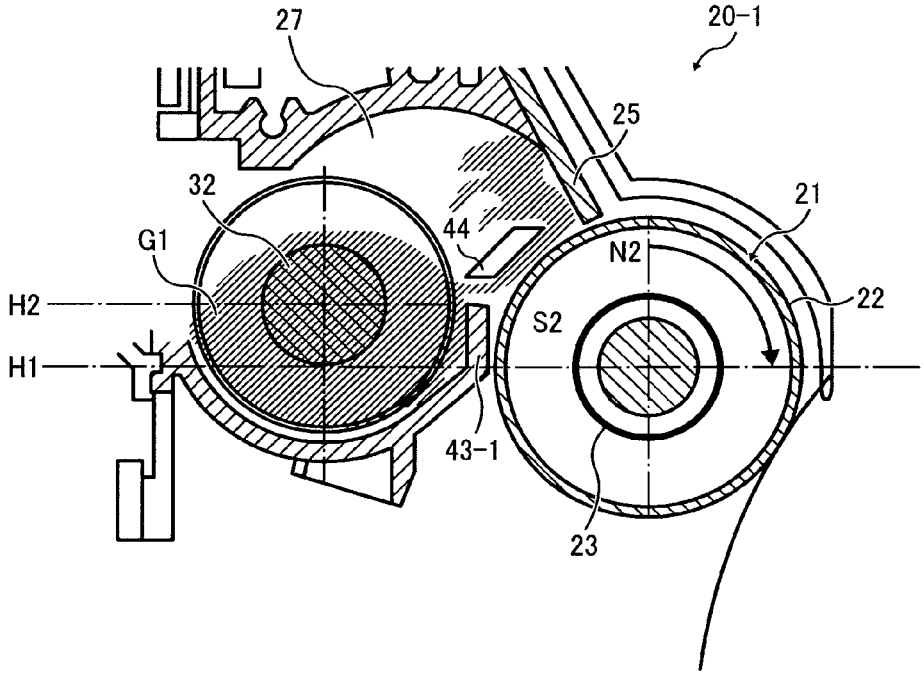
FIG. 14 illustrates an upper portion inside a development device according to a variation.

FIG. 14 illustrates an upper portion inside a development device 20-1 according to the first variation.

It is to be noted that, features of this variation can adapt to the second and third embodiments as well.

In the above-described development device 20, the upper end of the partition 43 (i.e., the sidewall of the supply compartment 27) is positioned lower than the rotary axis of the development roller 21 as shown in FIGS. 2 and 4. In such a configuration, the developer should be brought up against the gravity from the supply compartment 27 to supply it beyond the upper end of the partition 43 to the surface of the development sleeve 22. To bring up the developer, the resultant of the magnetic force generated by the attraction pole S2 and that generated by the regulation pole N2 positioned adjacent to and downstream from the attraction pole S2 in the rotational direction of the development sleeve 22 should be relatively large. As a result, the stress applied to the developer increases. In this state, for example, as the friction between the toner particles and the carrier particles in the developer increases, the temperature of the developer rises, softening the toner, which is not desirable. In addition, the coat of the carrier particles is abraded, and thus the useful life of the developer is reduced.

In view of the foregoing, referring to FIG. 14, a partition 43-1 of the supply compartment 27 has a height H2 higher than a height H1 of the rotary axis of the development roller 21 in a development device 20-1 according to the first variation. With this configuration, when the developer is supplied from the supply compartment 27 beyond the upper end of the partition 43-1 to the development sleeve 22, the developer can fall under its own weight from the upper end of the partition 43-1 onto the surface of the development sleeve 22. Accordingly, the developer can be supplied reliably to the development sleeve 22 even when the magnetic force exerted by the attraction pole S2 is smaller compared with a configuration in which the developer is brought up against the gravity.

Figure 15:
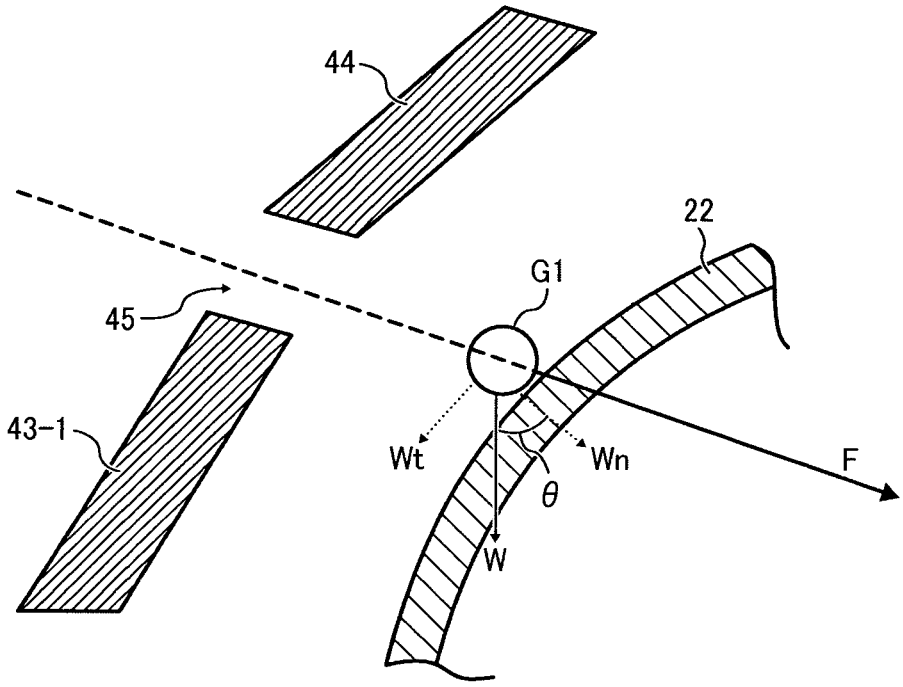
FIG. 15 is a schematic diagram that illustrates developer supplied to the development sleeve through the slit between the partition and the shielding wall in the development device shown in FIG. 14.

FIG. 15 is a schematic diagram that illustrates the developer supplied to the development sleeve 22 through the slit 45 between the partition 43-1 and the shielding wall 44 in the development device 20-1 according to the first variation.

In the first variation, the developer G transported through the slit 45 is supplied to a portion of the development sleeve 22 higher than the rotary axis of the development sleeve 22. At that time, the resultant of the magnetic force F exerted by the attraction pole S2 and the weight W of the developer acts on a single developer particle, that is, a single magnetic carrier coated with toner. The weight W of the developer can be decomposed into a tangential component Wt in the direction tangential to the surface of the development sleeve 22 and a normal component Wn in the direction normal to the surface of the development sleeve 22. The normal component Wn of the weight W of the developer functions as an external force to move the developer G1 that has traveled through the slit 45, overstridden the upper end of the partition 43-1, toward the surface of the development sleeve 22. Therefore, the developer can be supplied reliably to the development sleeve 22 even when the magnetic force exerted by the attraction pole S2 is smaller compared with a configuration in which the developer is brought up against the gravity.

In addition, when the developer is supplied to the surface of the development sleeve 22, it is necessary that the friction force between the developer and the surface of the development sleeve 22 is sufficient for the developer carried thereon to follow the rotation of the development sleeve 22. In the configuration in which the developer is brought up against the gravity, the developer is supplied to a portion of the development sleeve 22 facing downward, and a normal component Wn' of the weight W of such developer is in the direction away from that portion in the surface of the development sleeve 22. Therefore, to generate a vertical drag force N required for the friction force between the surface portion of the development sleeve 22 facing downward and the developer carried thereon, it is necessary that the attraction pole S2 generates a magnetic force F having a normal component Fn equal to the sum of the vertical drag force N and the normal component Wn' of the weight W of such developer (Fn=N+Wn').

By contrast, in the first variation, the developer G1 is supplied to the surface portion of the development sleeve 22 facing upward. Accordingly, the normal component Wn of the weight W of the developer G1 is in the direction toward the surface of the development sleeve 22, and the required vertical drag force can be attained with a magnetic force F having a normal component Fn calculated by deducting the normal component Wn from the vertical drag force N (Fn=N−Wn). Therefore, the developer can follow the rotation of the development sleeve 22 even when the magnetic force exerted by the attraction pole S2 is smaller compared with the configuration in which the developer is brought up against the gravity. Accordingly, the developer can be supplied reliably to the development sleeve 22 even when the magnetic force exerted by the attraction pole S2 is smaller compared with the configuration in which the developer is brought up against the gravity. Consequently, the resultant of the magnetic force exerted by the attraction pole S2 and that by the regulation pole N2 can be reduced, thus reducing the stress to the developer.

Figure 16:
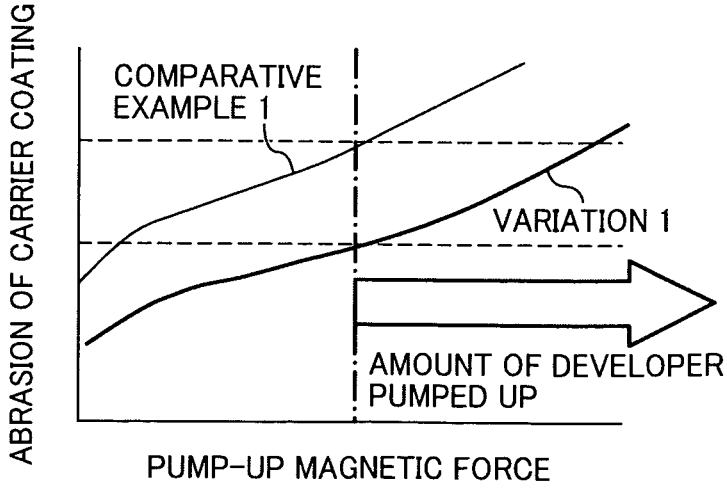
FIG. 16 is a graph illustrating the amount of abrasion of the coat of carrier particles in the variation and a comparative example in which the developer is pumped up against gravity to the development sleeve.

FIG. 16 is a graph illustrating the amount by which the coat of carrier particles is abraded in the first variation and a comparative example in which the developer is pumped up against gravity to the development sleeve 22.

As can be known from the graph shown in FIG. 16, the amount of abrasion of the coat of the carrier particles increases as the magnetic force (attraction magnetic force) exerted by the attraction pole S2 increases. In the first variation, because the required attraction magnetic force can be smaller, the sufficient amount of developer can be pumped up to the development sleeve 22, and simultaneously the abrasion of the coat of the carrier particles can be restricted, thus expanding the useful life of the developer.

(Second Variation)

Next, another variation of the development device according to the above-described first embodiment is described below (hereinafter "second variation") with reference to FIGS. 17 and 18.

It is to be noted that, features of this variation can adapt to the second and third embodiments as well.

In the above-described development device 20 according to the first embodiment, the developer G3 removed from the development sleeve 22 by the doctor blade 25 is retained by magnetic force from the regulation pole N2 in the retaining portion, which is upstream from the doctor blade 25 in the rotational direction of the development sleeve 22. As the amount of the retained developer G3 increases, the amount of developer circulating in the development device 20 decreases relatively. Accordingly, in supply-collection separation type development devices in which the developer that has passed through the development range is collected in the collection compartment 28 separate from the supply compartment 27 as in the above-described first embodiment, it is possible that the amount of developer supplied to the development sleeve 22 is insufficient on the downstream side of the supply compartment 27 in the developer conveyance direction. As described above, if the amount of developer pumped up to the development sleeve 22 is insufficient, the retained developer G3 attracted by the attraction magnetic force compensates for the shortage, and then the retained developer G3 is used in image development in the development range.

In the above-described first embodiment, the amount by which the developer G3 retained in the retaining portion is replaced (hereinafter "replacement amount of retained developer") is relatively small and identical developer particles tend to remain long in the retaining portion. As a result, the toner charge amount of the retained developer G3 can be remarkably high. Therefore, if the retained developer G3 passes through the regulation gap and is used in the image development, the image density becomes uneven.

Figure 17:
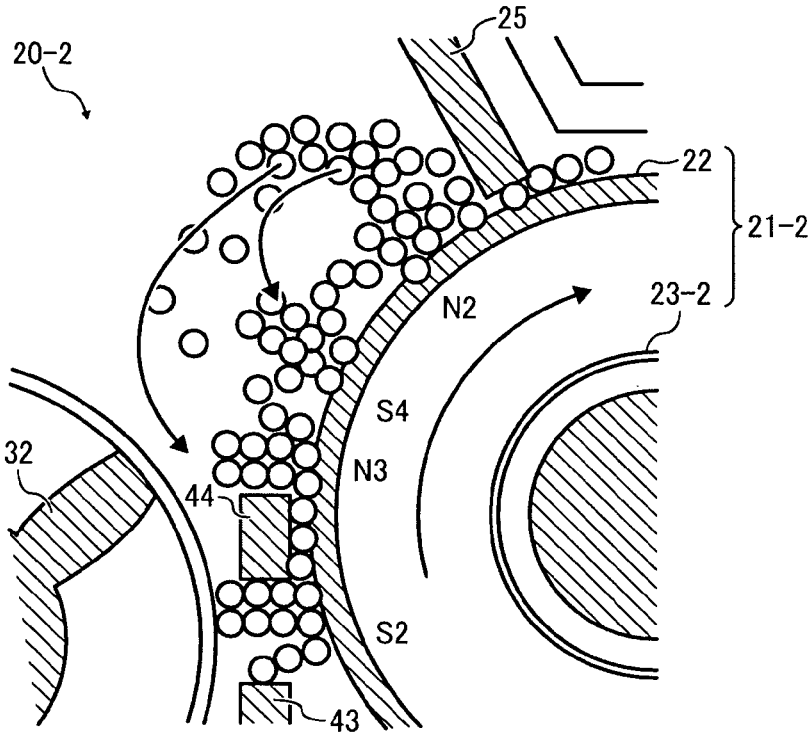
FIG. 17 illustrates an upper portion inside a development device according to another variation.

FIG. 17 illustrates an upper portion inside a development device 20-2 according to the second variation.

As shown in FIG. 17, in the second variation, a development roller 21-2 includes a magnet roller 23-2 configured to cause the developer to stand on end on the development sleeve 22 at least twice from an attraction position where the developer G1 is pumped up to the development sleeve 22 from the supply compartment 27 to a regulation position where the amount of the developer carried on the development sleeve 22 is adjusted by the doctor blade 25. More specifically, the magnet roller 23-2 has at least two stationary magnetic poles (S4 and N3) in a portion facing the range from the attraction position to the regulation position.

In the second variation, the developer G1 pumped up to the development sleeve 22 by the attraction pole S2 passes by the magnetic pole N3 as well as the magnetic pole S4 before reaching the regulation gap.

With this configuration, the developer G1 having normally charged toner, pumped up by the attraction pole S2 changes its state sequentially at the positions facing the multiple magnetic poles before reaching the regulation gap. That is, while being transported from the attraction position to the regulation position, the developer lies, stands when passing by the magnetic pole N3, lies, stands when passing by the magnetic pole S4, and again lies. While the developer G1 repeatedly lies and stands on end on the development sleeve 22, the retained developer G3 is mixed in the developer G1, and simultaneously the developer G1 is partly retained in the retaining portion and mixed with the retained developer G3. Thus, replacement of the retained developer G3 is facilitated, developer particles can be inhibited from remaining long in the retaining portion. Consequently, the excessive rise in the charge amount of toner in the retained developer can be prevented, and unevenness in the image density can be restricted even when the shortage of the developer G1 supplied to the development sleeve 22 is compensated by the retained developer G3.

Figure 18:
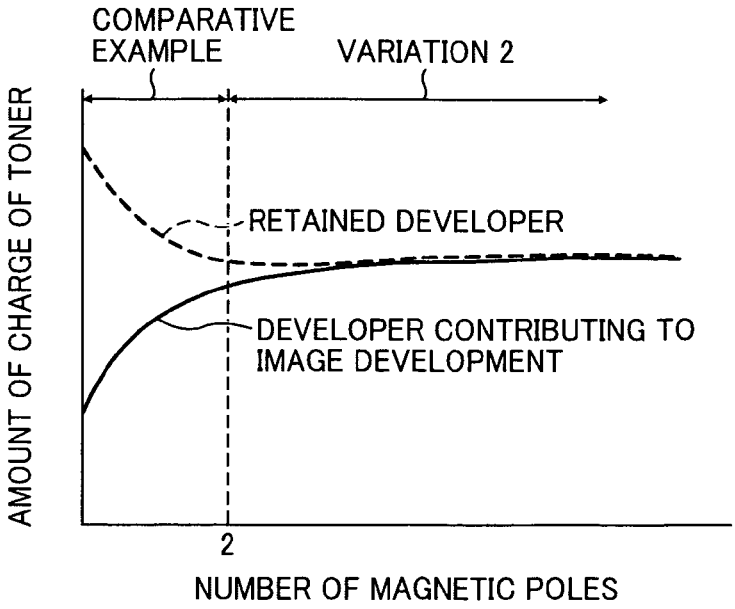
FIG. 18 is a graph that illustrates the relation between the number of magnetic poles positioned between an attraction position to a regulation position and the charge amount of toner in the retained developer and that in the developer contributing to image development.

FIG. 18 is a graph that illustrates the relation between the number of magnetic poles positioned between the attraction position to the regulation position and the charge amount of toner in the retained developer and that in the developer contributing to image development.

As shown in FIG. 18, in configurations in which the number of the stationary magnetic poles positioned from the attraction position to the regulation position is zero or one, the toner charge amount of the retained developer G3 and that of the developer contributing to the image development are different significantly. Therefore, if these developers are used to develop an identical image, the unevenness in the image density might be significant.

By contrast, in the second variation in which two stationary magnetic poles are provided in the range from the attraction position to the regulation position, the difference between the toner charge amount of the retained developer G3 and that of the developer contributing to the image development can be limited. Therefore, even if these developers are used to develop an identical image, significant unevenness in the image density does not occur.

It is to be noted that, although the above-described configuration concerns providing at least two stationary magnetic poles between the attraction position to the regulation position, alternatively, the magnet roller may be configured so that multiple magnetic poles move in the rotational direction of the development sleeve 22 to cause the developer to stand on end on the development sleeve 22 at least twice from the attraction position to the regulation position.

(Third Variation)

Next, yet another variation of the development device according to the above-described first embodiment is described below (hereinafter "third variation") with reference to FIGS. 19 through 21.

It is to be noted that, features of this variation can adapt to the second and third embodiments as well.

In the above-described first embodiment, the slit 45, which is provided between the partition 43 and the shielding wall 44, extends relatively long in the axial direction of the development sleeve 22. The partition 43 defining the lower end of the slit 45 can be integrated with the casing of the development device 20 forming the sidewall of the supply compartment 27 over the entire length in the axial direction of the development sleeve 22. Therefore, the partition 43 does not deform even when pushed toward the development sleeve 22 by the developer passing through the slit 45.

By contrast, the upper side of the shielding wall 44 is not supported because the retaining portion is provided above it, and the lower side of the shielding wall 44 is not supported because the slit 45 is provided under it. Thus, the shielding wall 44 is supported only in the end portions in the axial direction of the development sleeve 22. Accordingly, the shielding wall 44 deforms with the axial end portions as fulcrums when pushed toward the development sleeve 22 by the developer passing through the slit 45. If the amount by which the shielding wall 44 deforms is large, the shielding wall 44 contacts the development sleeve 22, resulting in production of substandard images, abnormal noise, or unintended products.

Figure 19:
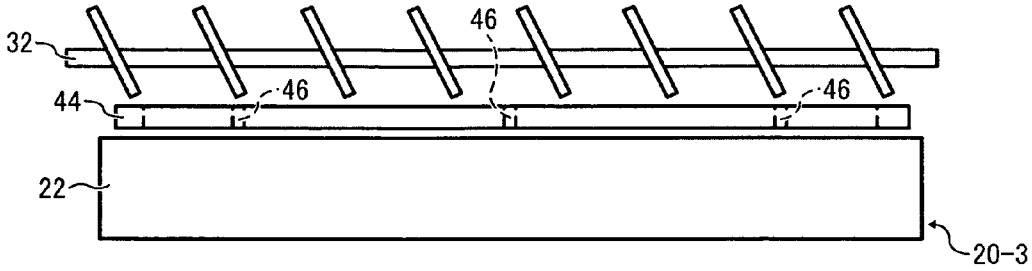
FIG. 19 is a schematic top view illustrating an interior of a development device according to another variation.
Figure 20:
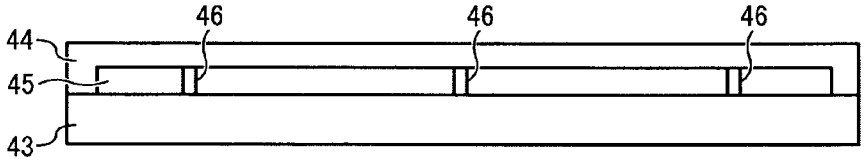
FIG. 20 is an enlarged view of a slit in the development device shown in FIG. 19.

FIG. 19 is a schematic top view illustrating an interior of a development device 20-3 according to the third variation. FIG. 20 is an enlarged view of the slit in the third variation.

The shielding wall 44 may be connected to the partition 43 at one position or greater multiple positions in the axial direction of the development sleeve 22. As shown in FIGS. 19 and 20, the development device 20-3 according to the third variation includes at least one rib 46 (connector) positioned in the slit 45 for connecting the partition 43 to the shielding wall 44. In the configuration shown in FIGS. 19 and 20, three ribs 46 are provided in the axial direction of the development sleeve 22. It is preferable that each rib 46 have a maximum width (i.e., the length in the axial direction of the development sleeve 22) of 1 mm or less. Connecting the shielding wall 44 to the partition 43 with the ribs 46 can enhance the strength of the shielding wall 44 and inhibit the shielding wall 44 from deforming toward the development sleeve 22, pushed by the developer passing through the slit 45. It is to be noted that, the number of the ribs 46 is not limited to those shown in FIGS. 19 and 20 but can be determined as required.

An image quality evaluation was executed to examine the relation between image quality and the width (i.e., the length in the axial direction of the development sleeve 22) of each rib 46. Table 1 shows the results of evaluation. In the evaluation, the output images were visually observed, and the image quality was classified as level 1 when no substandard images are produced, level 2 when the image density is lower but is acceptable, and level 3 when the image density is excessively low and cannot be accepted.

TABLE 1

| Width of rib (mm) | Image quality level |
|---|---|
| 0.7 | 1 |
| 1.0 | 2 |
| 1.5 | 3 |
| 2.0 | 3 |

When the width of each rib 46 was not greater than 1 mm, acceptable images of image quality level 1 or 2 were output. However, when the width of the ribs 46 was greater than 1.5 mm, the image quality ranked level 3, and thus the output images were not acceptable. In this example, the ribs 46 blocked the supply of developer from the supply compartment 27 to the development sleeve 22, and the retained developer was carried on the development sleeve 22 at that portions. Consequently, the retained developer having the higher toner charge amount was used to develop the image, decreasing the image density.

As described above, when the length (width) of each rib 46 in the axial direction of the development sleeve 22 is not greater than 1 mm, the strength of the shielding wall 44 can be enhanced so as to prevent the shielding wall 44 from deforming and contacting the development sleeve 22 without degrading the quality of output images.

Figure 21:
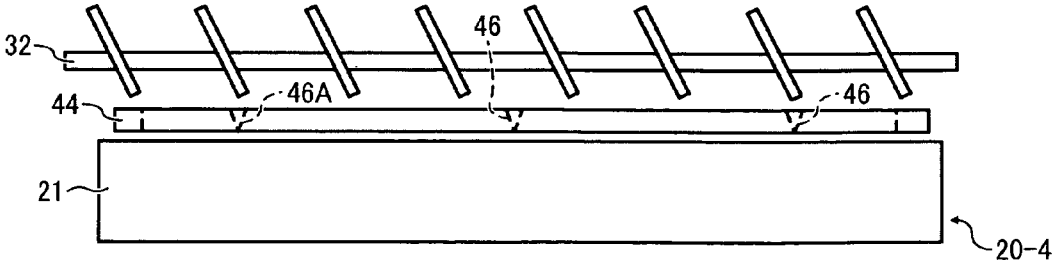
FIG. 21 is a schematic top view illustrating a configuration of ribs in the development device shown in FIG. 19.

FIG. 21 illustrates ribs 46A as a variation of the connector for connecting the shielding wall 44 to the partition 43.

The ribs 46A shown in FIG. 21 are tapered toward the development sleeve 22. The tapered ribs 46A are preferable in that it can facilitate movement of the developer that has passed through the slit 45 to the back side of the ribs 46A (toward the development sleeve 22) and can prevent shortage of the developer supplied to the development sleeve 22 at the portions facing the ribs 46A. Table 2 shows evaluation results of images output by the configuration shown in FIG. 21. The image quality levels shown herein are similarly to those in Table 1 shown above. It is to be noted that the width of the rib in table 2 means the maximum width of each rib 46A. When the width of the ribs 46A was not greater than 1.5 mm, acceptable images of image quality level 1 or 2 were output. That is, when the width of the ribs 46A is not greater than 1.5 mm, the strength of the shielding wall 44 can be enhanced without degrading the quality of output images.

TABLE 2

| Width of rib (mm) | Image quality level |
|---|---|
| 0.7 | 1 |
| 1.0 | 1 |
| 1.5 | 2 |
| 2.0 | 3 |

(Fourth Variation)

Next, yet another variation of the development device according to the above-described first embodiment is described below (hereinafter "fourth variation").

It is to be noted that, features of this variation can adapt to the second and third embodiments as well.

The force exerted by the screw blade 34 of the supply screw 32 for conveying the developer to the development sleeve 22 is not uniform in the axial direction, and there are portions where the force for forwarding the developer to the development sleeve 22 is weaker. In such portions, it is possible that the retained developer G3 attracted by the attraction magnetic force hinders pumping up the developer G1 from the supply compartment 27, resulting in the shortage of the developer pumped up. As a result, the retained developer G3 attracted by the attraction magnetic force is carried in the area closer to the surface of the development sleeve 22 and transported through the regulation gap to the development range. Consequently, the image density becomes uneven.

The following approaches may be adopted to restrict the unevenness in image density caused by the axial unevenness in the force exerted by the screw blade 34 of the supply screw 32 for conveying the developer to the development sleeve 22.

As a first approach, the pitch of the screw blade 34 in the axial direction may be reduced. Although this approach can reduce the axial unevenness in the force of the screw blade 34 of the supply screw 32 for forwarding the developer and the unevenness in image density, simply reducing the pitch of the screw blade 34 decreases the velocity at which the supply screw 32 transports the developer (i.e., the amount of developer conveyed per unit time). Therefore, to secure the necessary conveyance mount of developer per unit time, it is necessary to increase the rotational frequency of the supply screw 32 or the external diameter of the screw blade 34. As a result, the stress to the developer increases, and the developer may coagulate or deteriorate due to a rise in the temperature of the developer. In addition, the development device may increase in size.

As a second approach, the number of threads of the screw blades 34 may be increased. Although this approach can reduce the axial unevenness in the force of the screw blade 34 forwarding the developer and the unevenness in image density, as the number of the threads thereof increases, the screw blade 34 occupies more of the space in the supply compartment 27, reducing the capacity for containing the developer. Accordingly, the amount of developer conveyed (hereinafter "developer conveyance mount") per unit time is reduced, thus inviting the inconvenience similar to that in the first approach.

In view of the foregoing, in the fourth variation, the rotary shaft 33 of the supply screw 32 is constructed of nonmagnetic metal and does not include resin. Typically, developer conveyance screws are made of resin entirely or constituted of a resin screw blade and double layered rotary shaft including a metal base and a resin overlying the metal base. By contrast, in the fourth variation, because the rotary shaft 33 of the supply screw 32 is made of nonmagnetic metal having a strength greater than that of the resin, and the diameter of the rotary shaft 33 can be reduced from conventional rotary shafts that are made of resin entirely. In addition, even compared with conventional double layered rotary shafts constructed of a metal base coated with resin, the diameter of the supply screw 32 according to the fourth variation can be reduced for the amount of the resin coat. The reduction in diameter of the rotary shaft 33 can reduce the occupancy of the supply screw 32 in the developer conveyance compartments, thus increasing the capacity for containing the developer. Accordingly, the developer conveyance amount per unit time can be increased.

In the fourth variation, even when the above-described first or second approach is adopted to reduce the unevenness in image density, the increase in the rotational frequency of the supply screw 32 or that in the external diameter of the screw blade 34 can be unnecessary or minimized. Therefore, the unevenness in image density can be alleviated without an increase in the stress to the developer, which causes a rise in the temperature of the developer. Thus, coagulation or degradation of the developer as well as increases in size of the development device can be restricted.

Similarly, the collecting screw 35 may include a nonmagnetic metal rotary shaft to reduce the diameter compared with resin rotary shafts or double layered rotary shafts including the metal base coated with resin. Thus, the developer conveyance amount can be increased with the above-described inconvenience alleviated.

It is to be noted that, in the above-described first through third embodiment as well as the variations thereof, the voltage applied to the development roller 21, 221A, or 321A is preferably an alternating current (AC) voltage. This voltage may be either a symmetric AC voltage in which the positive and negative peak voltages have the same value or an asymmetric AC voltage in which direct-current (DC) voltage is superimposed on such an AC voltage. The peak-to-peak voltage is preferably within a range of from 300 V to 3,000 V, and the frequency is preferably within a range of from 200 Hz to 10,000 Hz. The peak-to-peak voltage and the frequency are set within these ranges depending on the development process. For example, the waveshape of the voltage can be triangular, rectangular, or a shape with the duty ratio changed. Such an AC voltage can enhance the development efficiency, and satisfactory images can be attained even when the amount of developer supplied to the development range is smaller compared with DC voltage. Therefore, the regulation gap between the between the development roller (21, 221A or 321A) and the doctor blade (25, 225, or 325) can be reduced, and thus only the developer positioned close to the surface of the development roller 21 can pass through the regulation gap. Therefore, the retained developer G3 can be further inhibited from passing through the regulation gap, and effects of the shielding wall (44, 244, or 344) for preventing degradation in image quality can be increased.

Additionally, in the above-described first through third embodiments and the respective variations, making the magnetic force generated by the attraction pole S2 smaller than that generated by the regulation pole N2 can generate a magnetic field that exerts a magnetic force for conveying the developer carried on the development sleeve 22 downstream in the rotational direction of the development sleeve 22. Such magnetic force can act on the developer carried on the development sleeve 22 in the direction identical or similar to the rotational direction of the development sleeve 22, thus facilitating conveyance of developer by the development sleeve 22. Further, the reduction in the magnetic force of the attraction pole S2 can alleviate the degradation of developer.

In addition, when the amount of developer supplied to the development range is smaller, the required amount of developer contained in the supply compartment (27, 227, 327) can be reduced. Therefore, the pitch of the screw blade of the supply screw (32, 232, 332) in the axial direction or the number of threads of the screw blade can be increased to restrict the axial unevenness in the force for forwarding the developer to the development roller (21, 221A, or 321A). With this effects in addition to that of the shielding wall (44, 244, or 344), the degradation in image quality resulting from the uneven image density can be alleviated better. Moreover, when the required amount of developer contained in the supply compartment is smaller, the external diameter of the screw blade or the rotational frequency of the supply screw can be reduced, which is advantageous in preventing the developer from deteriorating or coagulating as well as keeping the development device compact.

As described above, the image forming apparatus according to the above-described first through third embodiments includes the photoreceptor 3 serving as the latent image bearer; the charging unit 4 and the optical writing unit 10 together forming the latent image forming unit; and the development device 20, 220, or 320 for developing the latent image formed on the photoreceptor 3 with the developer including the toner and the carrier. The image forming apparatus transfers the toner image from the photoreceptor 3 to the recording sheet P (recording medium), thus forming an output image. The development device 20, 220, or 320 includes the development roller (21, 221A, or 321A) including the development sleeve (22, 221A, or 321A) serving as the developer bearer for transporting the developer by rotation to the development range facing the photoreceptor 3 as well as the magnet roller (23) provided inside the development sleeve for generating the magnetic force for carrying the developer on the surface of the development sleeve, the doctor blade (25, 225, or 325) positioned across the regulation gap from the surface of the development sleeve for adjusting the amount of developer transported to the development range, and the developer conveyance compartments.

The developer conveyance compartments includes the supply compartment (27, 227, or 327) positioned adjacent to the development sleeve, and the developer is supplied by the supply screw (32, 232, or 332) from the supply compartment to the development sleeve while conveyed in the axial direction of the development sleeve. The developer blocked by the doctor blade is also collected in the supply compartment. The magnet roller includes at least the attraction pole S2 to generate the attraction magnetic force for attracting the developer to the development sleeve from the supply compartment beyond the upper end of the partition (43, 243, or 343) forming the sidewall of the supply compartment and the regulation pole N2 to generate the regulation magnetic force for causing the developer to stand on end on the development sleeve when the developer passes through the regulation gap. The attraction pole S2 and the regulation pole N2 have the reverse polarities. Further, the attraction pole S2 and the regulation pole N2 are adjacent to each other in the rotational direction of the development sleeve (except the second variation shown in FIG. 17).

Further, the shielding wall (44, 244, or 344) are provided for inhibiting the retained developer G3 that has been blocked by the doctor blade from moving toward the surface of the development sleeve along the magnetic force lines of the regulation magnetic force. The shielding wall is positioned across slit 45 from the partition, and the slit 45 extends at least over the maximum image forming range in the axial direction of the development sleeve for allowing the developer to move from the supply compartment to the development sleeve. The shielding wall can inhibit the retained developer G3 attracted by the attraction magnetic force from moving toward the development sleeve. Further, the shielding wall are provided across the slit 45 for inhibiting the retained developer G3 that has been blocked by the doctor blade from moving toward the surface of the development sleeve along the magnetic force lines of the regulation magnetic force. The slit 45 extends at least over the maximum image forming range in the axial direction of the development sleeve for allowing the developer to move from the supply compartment to the development sleeve. The shielding wall can inhibit the retained developer G3 attracted by the attraction magnetic force from moving toward the development sleeve and from hindering pumping up the developer G1 from the supply compartment. Therefore, the local shortage of the developer G1 pumped up from the supply compartment can be prevented or restricted, and the developer G3 is less likely to be held in the portion adjacent to the surface of the development sleeve, capable of passing through the regulation gap. Accordingly, the above-described developer layer in which the developer G3 including the excessively charged toner and the developer G1 including the normally charged toner are mixed insufficiently is not conveyed to the development range, thus restricting unevenness in the image density and the degradation of image quality.

In addition, the supply screw (32, 232, or 332) includes the screw-shaped blade 34 provided on the rotary shaft and transports the developer in the supply compartment (27, 227, or 327) in the direction of its rotary axis. The rotary shaft 33 of the supply screw may be constructed of nonmagnetic metal only and does not include resin, and the screw-shaped blade 34 may be constructed of resin.

In addition, the development devices 20, 220, and 320 are supply-collection separation type and include the collection compartment (28, 228, or 328) positioned adjacent to the surface of the development sleeve (22, 221A, or 321A) separated from the supply compartment (27, 227, or 327). The developer G2 that has passed through the development range is collected in the collection compartment, and the collecting screw (35, 235, or 335) transports the developer G2 in the axial direction of the development sleeve. According to the above-described first through third embodiments, satisfactory images can be obtained even in such supply-collection separation type development devices.

In addition, the magnet roller generates the release magnetic force for separating the developer G2 that has passed through the development range from the development sleeve and guiding it to the collection compartment, and the upper end of the partition (43, 243, or 343) is disposed downstream in the rotational direction of the development sleeve from the release portion in which the releaser magnetic force acts. With this configuration, the developer G2 separated from the development sleeve is blocked by the partition and does not move to the supply compartment beyond the partition. Accordingly, the developer G2 having a reduced toner concentration can be prevented from being carried over to the development range.

In addition, the relative positions of the supply compartment and the development sleeve are determined sot that the developer G1 that has overstridden the upper end of the partition can move in a direction inclined upward from a horizontal plane due to the attraction magnetic force. Although, in such a configuration in which the developer is pumped up against the gravity, the attraction magnetic force is stronger and accordingly the force attracting the developer G3 to the attraction pole S2 is stronger, satisfactory images can be obtained with the effects of the above-described first through third embodiments.

In addition, the development devices according to the above-described first through third embodiments are configured so that the level of the developer G1 in the supply compartment during image formation is higher than the upper end of the partition at least over the entire length of the image formation range in the axial direction of the development sleeve. For example, the change in the amount of developer can be estimated preliminarily, and the height of the partition may be designed so that the level of the developer G1 in the supply compartment during image formation is higher than the upper end of the partition at least over the entire image formation range in the axial direction. Further, since the supply screw rotates upward in the portion where the supply screw faces the development sleeve, the level of the developer can be higher on the side close to the development sleeve than the side away from the development sleeve.

This configuration can make it easy for the developer G in the supply compartment to overstride the upper end of the partition, and accordingly the developer G1 can move to the development sleeve smoothly through the slit. Therefore, the image density can be kept uniform, and the image quality is not degraded.

In addition, the development devices according to the above-described first and second embodiments are configured so that the attraction magnetic force can cause the developer to stand on end on the surface of the shielding wall (44 or 244) facing the supply compartment (27 or 227). The developer G4 standing on end on the shielding wall can form the wall to block the movement of the retained developer G3 attracted by the attraction magnetic force toward the slit. Therefore, the retained developer G3 can be better prevented from going through the slit.

In addition, the both end portions of the slit (45) in the axial direction of the development sleeve are positioned outside the maximum image forming range in that direction, and thus a sufficient amount of developer can be supplied to the axial end portions of the image forming range. Therefore, the retained developer G3 is not carried on the axial end portions of the development sleeve and is not used in image development. Therefore, unevenness in the image density can be restricted.

In addition, in the above-described first through third embodiments, it is preferable that the shielding wall (44, 244, or 344) be constructed of a nonmagnetic material not to affects the magnetic fields generated by the magnet roller.

In addition, the shielding wall are preferably constructed of a metal material to attain a necessary rigidity at a lower cost. It is to be noted that, when the shielding wall is electrically charged by the friction with the developer to such an extent that the difference in electrical potential between the shielding wall and the development sleeve is equal to or greater than the electric discharge starting voltage, an electric discharge occurs, degrading the quality of the image portion corresponding to the electric discharge. Therefore, the shielding wall preferably have an electrical potential identical or similar to that of the development sleeve. More specifically, for example, the doctor blade (25, 225, or 325) is electrically connected to the development sleeve to have the same or similar potential, and the shielding wall is electrically connected to such a doctor blade. Alternatively, the shielding wall may be connected to the development sleeve directly. The former is more preferable in that the occurrence of electrical discharge between the doctor blade and the shielding wall can be prevented as well.

Numerous additional modifications and variations are possible in light of the above teachings. It is therefore to be understood that, within the scope of the appended claims, the disclosure of this patent specification may be practiced otherwise than as specifically described herein.

What is claimed is:

1. A development device comprising:

a cylindrical developer bearer to carry by rotation two-component developer including toner and magnetic carrier particles to a development range where the developer bearer faces a latent image bearer;

a magnetic field generator disposed inside the developer bearer for generating magnetic force;

a developer regulator disposed upstream from the development range in a rotational direction of the developer bearer and facing a circumferential surface of the developer bearer across a regulation gap for adjusting an amount of the developer carried by the developer bearer to the development range;

a supply compartment disposed adjacent to the developer bearer, from which the developer is supplied to the developer bearer and in which the developer removed from the developer bearer by the developer regulator is collected, the supply compartment partially separated by a side wall from a portion where the developer bearer is provided, a developer agitator provided in the supply compartment for transporting the developer in an axial direction of the developer bearer; and a blocker disposed facing an upper end of the side wall of the supply compartment across a supply gap through which the developer moves from the supply compartment toward the developer bearer, the supply gap extending at least over an entire development range in the axial direction of the developer bearer, wherein the magnetic field generator has an attraction magnetic pole for generating an attraction magnetic force to attract the developer from the supply compartment beyond the upper end of the side wall of the supply compartment to the circumferential surface of the developer bearer as well as a regulation magnetic pole for generating a regulation magnetic force to cause the developer passing through the regulation gap to stand on end on the circumferential surface of the developer bearer, the regulation magnetic pole adjacent to the attraction magnetic pole and having a polarity opposite a polarity of the attraction magnetic pole, and the blocker prevents the developer blocked by the developer regulator from moving toward the circumferential surface of the developer bearer along a magnetic force line of the regulation magnetic force.

2. The development device according to claim 1, wherein the magnetic field generator and the blocker are designed so that, when a first magnetic carrier particle is positioned at an edge of an edge face of the blocker facing the supply compartment in a state in which no developer is present in the development device, a resultant of the magnetic force and the gravity acting on the first magnetic carrier particle is inclined away from the supply gap.

3. The development device according to claim 1, wherein the developer agitator provided in the supply compartment comprises a rotary shaft and a screw blade provided on the rotary shaft for transporting the developer in an axial direction thereof in the supply compartment, and a straight line that passes through a center of rotation of the developer bearer as well as that of the developer agitator provided in the supply compartment also passes through the supply gap as viewed in the axial direction of the developer bearer.

4. The development device according to claim 1, wherein relative positions of the supply compartment and the developer bearer are designed so that the attraction magnetic force causes the developer that has overstridden the side wall of the supply compartment to move in a direction inclined upward from a horizontal plane.

5. The development device according to claim 4, wherein, when a second carrier particle is disposed at an upper edge of the side wall of the supply compartment in a state in which no developer is present in the development device, a resultant of the magnetic force and the gravity acting on the second magnetic carrier particle is inclined upward or in parallel to a horizontal plane.

6. The development device according to claim 1, wherein the supply gap is 2 mm or greater in the rotational direction of the developer bearer.

7. The development device according to claim 1, wherein a level of the developer in the supply compartment during image formation is higher than the upper end of the side wall of the supply compartment at least over an entire length of an image formation range in the axial direction of the developer bearer.

8. The development device according to claim 1, wherein the magnetic field generator and the blocker are designed so that, the developer is carried on a surface of the blocker facing the supply compartment by the attraction magnetic pole of the magnetic field generator.

9. The development device according to claim 1, wherein, in a portion where the blocker is closest to the circumferential surface of the developer bearer, a gap between the blocker and the circumferential surface of the developer bearer is greater than the regulation gap.

10. The development device according to claim 1, wherein both axial end portions of the developer bearer are positioned outside a maximum image formation range.

11. The development device according to claim 1, the developer agitator provided in the supply compartment comprises a rotary shaft and a screw blade provided on the rotary shaft for transporting the developer in an axial direction thereof in the supply compartment, the developer agitator rotates so that the screw blade moves upward at a circumference of the developer agitator facing the developer bearer, and the blocker guides the developer that has been blocked by the developer regulator to a downstream side of the supply compartment in a direction in which the developer agitator rotates.

12. The development device according to claim 1, wherein the upper end of the side wall of the supply compartment is positioned higher than a center of rotation of the developer bearer.

13. The development device according to claim 1, wherein the regulation magnetic force is greater than the attraction magnetic force.

14. An image forming apparatus comprising:

the latent image bearer on which an electrostatic latent image is formed; and the development device according to claim 1.

15. A development device comprising:

a cylindrical developer bearer to carry by rotation two-component developer including toner and magnetic carrier particles to a development range where the developer bearer faces a latent image bearer;

a magnetic field generator disposed inside the developer bearer and including multiple magnetic poles for generating magnetic force, a developer regulator disposed upstream from the development range in a rotational direction of the developer bearer and facing a circumferential surface of the developer bearer across a regulation gap for adjusting an amount of the developer carried by the developer bearer to the development range;

a supply compartment disposed adjacent to the developer bearer, from which the developer is supplied to the developer bearer and in which the developer removed from the developer bearer by the developer regulator is collected, the supply compartment partially separated by a side wall from a portion where the developer bearer is provided;

a developer agitator provided in the supply compartment for transporting the developer in an axial direction of the developer bearer; and a blocker disposed facing an upper end of the side wall of the supply compartment across a supply gap through which the developer moves from the supply compartment toward the developer bearer, the supply gap extending at least over an entire development range in the axial direction of the developer bearer, wherein the blocker prevents the developer blocked by the developer regulator from moving toward the circumferential surface of the developer bearer along a magnetic force line of the magnetic force exerted by the magnetic field generator.

16. The development device according to claim 15, wherein the upper end of the side wall of the supply compartment is positioned higher than a center of rotation of the developer bearer.

17. The development device according to claim 15, wherein the magnetic field generator has an attraction magnetic pole for generating an attraction magnetic force to attract the developer from the supply compartment beyond the upper end of the side wall of the supply compartment to the circumferential surface of the developer bearer as well as a regulation magnetic pole for generating a regulation magnetic force to cause the developer passing through the regulation gap to stand on end on the circumferential surface of the developer bearer, and the regulation magnetic force is greater than the attraction magnetic force.

18. The development device according to claim 15, wherein the magnetic field generator comprises at least two stationary magnetic poles in a range from a position facing an attraction position where the developer is attracted from the supply compartment to the circumferential surface of the developer bearer to a position facing a regulation position where the developer regulator adjusts the amount of the developer.

19. The development device according to claim 15, wherein the magnetic field generator is rotatable, and the multiple magnetic poles thereof rotate in the rotational direction of the developer carrier so that the developer carried on the developer bearer stand on end on the developer bearer at least twice in a range from an attraction position where the developer is attracted from the supply compartment to the circumferential surface of the developer bearer to a regulation position where the developer regulator adjusts the amount of the developer.

20. An image forming apparatus comprising:

the latent image bearer on which an electrostatic latent image is formed; and the development device according to claim 15.

* * * * *